US012279667B2

(12) United States Patent
Ryan et al.

(10) Patent No.: US 12,279,667 B2
(45) Date of Patent: Apr. 22, 2025

(54) FOOTWEAR WITH TRANSFORMABLE SOLE SYSTEM

(71) Applicants: Stella Ryan, Whitinsville, MA (US); Jeffery Ryan, Whitinsville, MA (US)

(72) Inventors: Stella Ryan, Whitinsville, MA (US); Jeffery Ryan, Whitinsville, MA (US)

( * ) Notice: Subject to any disclaimer, the term of this patent is extended or adjusted under 35 U.S.C. 154(b) by 0 days.

(21) Appl. No.: 18/484,158

(22) Filed: Oct. 10, 2023

(65) Prior Publication Data

US 2024/0114994 A1 Apr. 11, 2024

Related U.S. Application Data

(60) Provisional application No. 63/415,018, filed on Oct. 11, 2022.

(51) Int. Cl.

| | |
|---|---|
| ***A43B 13/12*** | (2006.01) |
| ***A43B 3/24*** | (2006.01) |
| ***A43B 3/44*** | (2022.01) |
| ***A43B 13/20*** | (2006.01) |
| ***A43B 13/22*** | (2006.01) |
| ***A43C 15/14*** | (2006.01) |

(52) U.S. Cl.

CPC ..... *A43B 13/12* (2013.01); *A43B 3/246* (2013.01); *A43B 3/44* (2022.01); *A43B 13/203* (2013.01); *A43B 13/22* (2013.01); *A43C 15/14* (2013.01)

(58) Field of Classification Search

None

See application file for complete search history.

(56) References Cited

U.S. PATENT DOCUMENTS

| | | | | |
|---|---|---|---|---|
| 7,398,608 | B2 * | 7/2008 | Schoenborn | A43B 13/143 36/28 |
| 7,926,205 | B2 * | 4/2011 | Åmark | A43C 15/14 36/134 |
| 8,127,470 | B2 * | 3/2012 | Connor | A43C 15/168 36/134 |
| 8,215,034 | B2 * | 7/2012 | Krouse | A43C 15/161 36/134 |
| 9,609,904 | B2 * | 4/2017 | Zwick | A43B 5/02 |
| 9,839,256 | B2 * | 12/2017 | Campari | A43C 15/168 |
| 9,955,749 | B2 * | 5/2018 | Van Atta | A43B 7/148 |
| 9,999,278 | B2 * | 6/2018 | Feinstein | A43C 11/165 |

(Continued)

FOREIGN PATENT DOCUMENTS

IT 202100000269 A1 7/2022

OTHER PUBLICATIONS

International Search Report and Written Opinion on PCT Appln No. PCT/US2023/076463 dated Feb. 6, 2024 (10 pages).

*Primary Examiner* — Jila M Mohandesi

(74) *Attorney, Agent, or Firm* — FOLEY & LARDNER LLP

(57) ABSTRACT

Disclosed herein are systems and methods for transforming footwear. A footwear system includes one or more portions configured in a first profile. The footwear system includes one or more sensors configured to generate a value based on a surface in contact with at least one of the one or more portions. The footwear system includes an actuator configured to change, responsive to determining that the value satisfies a profile configuration condition, a configuration of the one or more portions from the first profile to a second profile in accordance with the surface.

9 Claims, 12 Drawing Sheets

(56) References Cited

U.S. PATENT DOCUMENTS

| | | | | |
|---|---|---|---|---|
| 10,039,339 | B2 * | 8/2018 | Zwick | A43B 3/26 |
| 10,702,020 | B2 * | 7/2020 | Chen | A43C 15/08 |
| 10,793,983 | B2 * | 10/2020 | Gladish | A43B 23/0245 |
| 10,856,612 | B2 * | 12/2020 | Heard | A43B 13/187 |
| 10,893,720 | B2 * | 1/2021 | Van Atta | A43B 7/00 |
| 11,122,851 | B2 * | 9/2021 | Winger | A43B 17/035 |
| 2011/0005103 | A1 * | 1/2011 | Krouse | A43C 15/161 36/134 |
| 2011/0047830 | A1 * | 3/2011 | Francello | A43C 15/14 36/134 |
| 2016/0309834 | A1 | 10/2016 | Zwick et al. | |
| 2018/0008005 | A1 * | 1/2018 | Compton | A43B 13/203 |
| 2020/0171351 | A1 | 6/2020 | Amrozowicz et al. | |
| 2020/0345109 | A1 * | 11/2020 | Riggins | A43B 5/02 |
| 2021/0045493 | A1 * | 2/2021 | Meschter | A43B 13/12 |
| 2021/0106095 | A1 * | 4/2021 | Van Atta | A43B 7/00 |

* cited by examiner

FOOTWEAR WITH TRANSFORMABLE SOLE SYSTEM

BACKGROUND

Articles of footwear generally include primary elements of an upper and a sole structure. The sole structure can be formed from a plurality of materials and can be configured for various situations and environments.

SUMMARY

The present disclosure relates generally to an article of footwear. More particularly, the present disclosure relates to the article of footwear having a sole that transforms based on a surface the sole is in contact with. The article of footwear described herein can be used for sports or for daily wear.

Articles of footwear, such as shoes, are subject to a variety of physically strenuous conditions. In one day, a shoe may be subject to lateral and longitudinal strains caused by walking, running, dancing, jumping, or other such bodily movements on a variety of surfaces, such as tile, grass, asphalt, or wood, among others. These articles of footwear can be worn down, especially on a sole of the footwear, by being used in conditions for which the article of footwear was not designed. For example, a shoe designed for ballet may disintegrate quickly when used for non-ballet activities. Athletic and non-athletic modes of mobility like walking, dancing, running, etc., have created an ultra-diversified space with niche offerings from cleated footwear, to footwear purposed for climbing, or footwear purposed for standing. Because articles of footwear are subject to such varying conditions while being mobile, it can be logistically difficult to coordinate footwear for a wearer each day. For example, transporting and packing a variety of footwear for different conditions or anticipated mobility can become burdensome.

As a result, oftentimes wearers are subject to wearing improper footwear for a given condition, due to logistical, economic, or other difficulties in owning and transporting various articles of footwear. Wearers may end up using footwear inappropriate for a given condition due to these difficulties. By wearing inappropriate articles of footwear, both the wearer and the shoe suffer. The wearer may become subject to performing physical activities with discomfort, pain, or extra precautions than if he were wearing appropriate footwear. The shoe may become subject to structural damage from unintended use thereby causing a reduced product lifetime for the shoe. Additionally, the shoe may wear inappropriately for its intended use. For example, a cleated shoe (such as used for soccer or football) may rapidly lose its cleats when worn on a concrete surface.

Furthermore, owning and damaging various types of footwear can have enormous environmental implication. The manufacturing of such various shoes to both suit various conditions and to replace shoes damaged by use in improper conditions can increase the global carbon footprint and waste precious environment resources. In some cases, unrecyclable materials are used in the production of footwear. Producing more types of footwear for each condition a wearer may be subject to, as well as disposing of various forms of damaged footwear (which may happen more frequently, due to a wearer using an article of footwear in an unintended condition) creates a large amount of waste. This production of articles of footwear can contribute greatly to greenhouse gas emissions caused by the production of such footwear as well as the disposal of such footwear.

The apparatus presented herein can provide a solution to the technical problems posed by traditional footwear, such as environmental waste, discomfort for the wearer, potential risk for injury, and longevity of the shoe. The apparatus described herein can include an article of footwear to be used in various situations such as playing soccer, football, and other sports as well as in various environments such as, but not limited to, grass, turf, clay, track, sidewalk, rock, snow or wet surfaces. Embodiments of the footwear described herein can determine properties of a surface including a type of the surface to cause the sole of the footwear to transform based on the determined surface.

The proposed article of footwear can include one or more sensors to determine properties of the surface. The article of footwear may determine properties of the surface such as a type (e.g., a material of the surface), reflectivity, slip between the article of footwear and the surface, friction, moisture, or hardness, among others. The article of footwear may determine properties of the wearer of the footwear, such as weight, acceleration, speed, pressure points of a foot, among others. For example, the article of footwear may determine a speed, acceleration, weight, movement, or other measurable attribute of a person wearing the footwear upon his or her foot by sensors disposed within the footwear, With the determined measurements, the article of footwear can determine a form corresponding to the determined measurements. The article of footwear can transform using one or more systems such as a pneumatic system, magnetic system, micro-electromechanical system (MEMS), or shape-memory polymers (SMPs), among others. The article of footwear can actuate one or more of these systems to change a profile of the article of footwear, such as a shape of a tongue of the footwear or a shape of a sole of the footwear. In this manner, the footwear can change dependent on a surface or activity of the wearer to provide an improved footwear experience.

By transforming the article of footwear, the overall number of shoes a wearer uses may be decreased. Decreasing a wearer's number of shoes can provide environmental benefits, due to a lessened production of non-biodegradable shoes emitting fewer greenhouse gases. Furthermore, the propensity of a wearer to don articles of footwear not intended for a particular condition can be reduced. Reducing improperly worn footwear can increase lifetime of a pair of shoes, further reducing waste due to quickly worn-out footwear. Comfort of the wearer can also be improved by providing for footwear suited for each condition that a wearer encounters. For example, the traction, spring, or generally ergonomics of the article of footwear can be improved by transforming for a wearer's specific foot as well as the particular conditions the wearer encounters. Therefore, performance, function, and reduction in waste can be increased by this technical solution of transformable shoes.

At least one aspect of the present disclosure is directed to a footwear system. The footwear system can include one or more portions configured in a first profile. The footwear system can include one or more sensors. The one or more sensors can generate a value based on a surface in contact with at least one of the one or more portions. The footwear system can include an actuator. The actuator can change, responsive to determining that the value satisfies a profile configuration condition, a configuration of the one or more portions from the first profile to a second profile in accordance with the surface.

In some embodiments, the surface is a first surface, the value is a first value, and the profile configuration condition is a first profile configuration condition. The actuator can change, responsive to determining that a second value based on a second surface in contact with the at least one of the one or more portions satisfies a second profile configuration condition, the configuration of the one or more portions from the second profile to a third profile in accordance with the second surface. In some embodiments, the actuator can be coupled with a memory. The actuator can identify, responsive to determining that the value satisfies the profile configuration condition, the second profile from a set of profiles stored in the memory based on the value. In some embodiments, the actuator is configured to expand at least one portion of the one or more portions in at least one of a longitudinal or lateral direction to change the configuration of the one or more portions from the first profile to the second profile. In some embodiments, the actuator can expand the at least one portion by length, width, height, or other such dimensions of the at least one portion.

In some embodiments, the one or more portions can include at least one of a shape memory polymer, a magnetic system, a micro-electromechanical system (MEMS), a thermal printer, or a pneumatic system. In some embodiments, the one or more portions can include a sole of the footwear system. The one or more portions configured in the first profile can include one or more protrusions extending from the sole at a first length. The one or more portions configured in the second profile can include the one or more protrusions extending from the sole at a second length. In some embodiments, to change the configuration of the one or more portions from the first profile to the second profile in accordance with the surface, the actuator can apply an electric stimulus to alter a state of a polymer of the one or more portions to cause the first profile to change to the second profile. In some embodiments, to change the configuration of the one or more portions from the first profile to the second profile, the actuator can apply an electrical stimulation to one of: a shape memory polymer to cause the shape memory polymer to change the one or more protrusions from the first length to the second length; a magnetic system to cause the one or more protrusions to change from the first length to the second length; a micro-electromechanical system (MEMS) to cause the one or more protrusions to change from the first length to the second length; a pneumatic system to cause the one or more protrusions to change from the first length to the second length; a thermal printer system to cause the one or more protrusions to change from the first length to the second length, or a flexible circuit board to cause the one or more protrusions to change from the first length to the second length.

In some embodiments, the one or more portions configured in the first profile can include the sole configured in a first sole pattern. The one or more portions configured in the second profile can include the sole configured in a second sole pattern. In some embodiments, the first sole pattern can include one of a first number of protrusions, first shape of protrusions, first dimension of protrusions, first rigidity of protrusions, and a first set of locations of protrusions. The second sole pattern can include one of a second number of protrusions, second shape of protrusions, second dimension of protrusions, second rigidity of protrusions, and a second set of locations of protrusions.

In some embodiments, the footwear system can include a reservoir including pneumatic fluid disposed within the one or more portions. To apply the electrical stimulation to the pneumatic system to cause the one or more protrusions to change from the first length to the second length, the actuator can control one or more valves of the one or more portions to generate a flow of the pneumatic fluid. In some embodiments, the one or more protrusions can include one or more magnetic protrusions. To apply the electrical stimulation to the magnetic system to cause the one or more protrusions to change from the first length to the second length the actuator can apply the electrical stimulation to at least one of the one or more magnetic protrusions. In some embodiments, the footwear system can include a user record. The user record can store information related to the surface and the one or more protrusions in accordance with a schedule. In some embodiments, the value is a first value. The one or more sensors can generate a second value based on a movement of the one or more portions. The actuator can change the configuration of the one or more portions from the first profile to the second profile based on the second value.

BRIEF DESCRIPTION OF THE DRAWINGS

The details of one or more implementations of the subject matter described in this specification are set forth in the accompanying drawings and the description below. Other features, aspects, and advantages of the subject matter will become apparent from the description, the drawings, and the claims.

Like reference numbers and designations in the various drawings indicate like elements.

DETAILED DESCRIPTION

Figure 1:
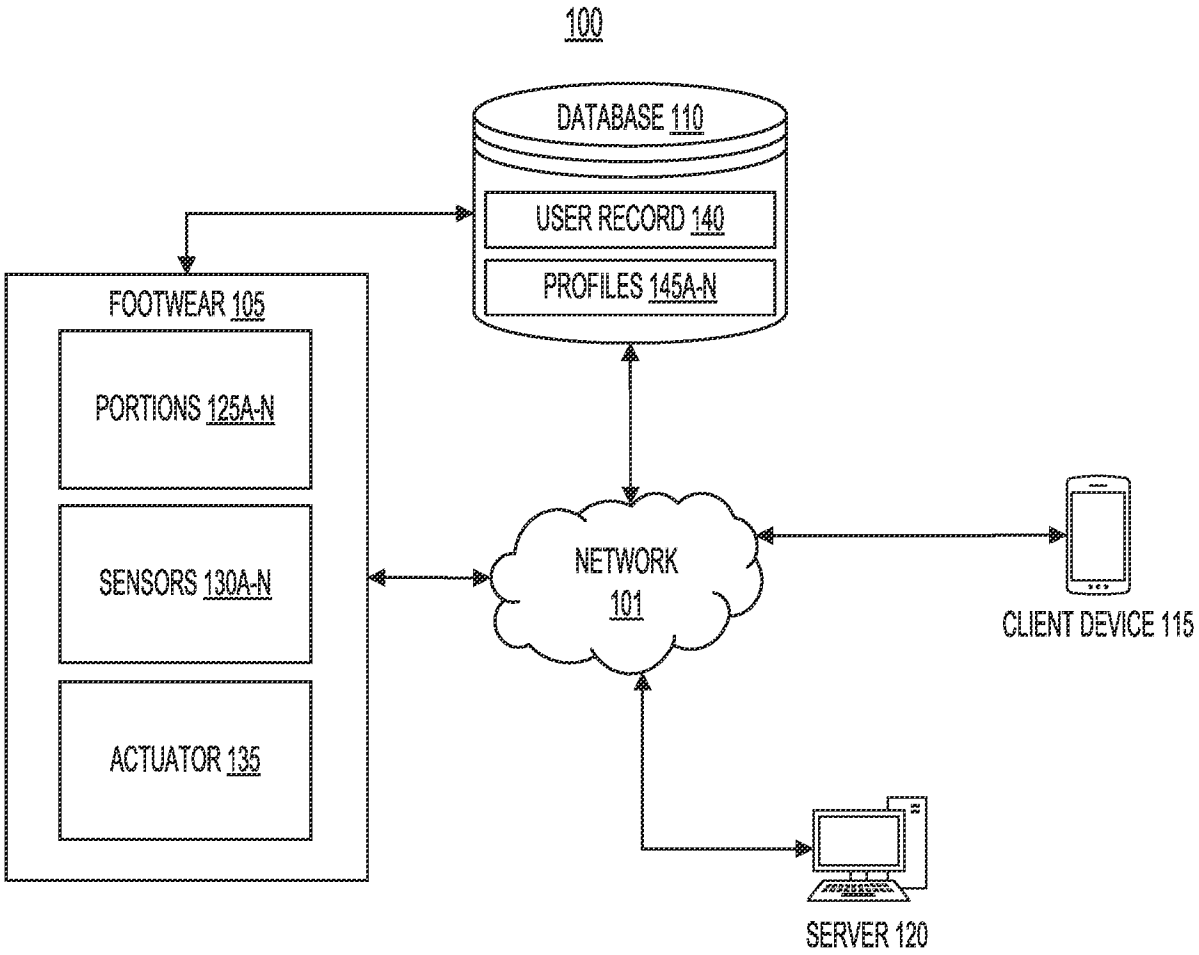
FIG. 1 illustrates a block diagram of an example footwear system, in accordance with one or more implementations.

Below are detailed descriptions of various concepts related to transforming a profile of a sole of a shoe. The various concepts introduced above and discussed in greater detail below can be implemented in any of numerous ways, as the described concepts are not limited to any particular manner of implementations. Examples of specific implementations and applications are provided primarily for illustrative purposes.

The present solution can transform the profile of one or more portions of the shoe upon contact with a surface. The process of changing shoes for various sports and for various purposes can be logistically challenging, wasteful, and reduce the lifetime of a shoe and a wearer's experience with the shoe. For example, wearing the ideal shoe for certain conditions such as hiking, wet surfaces, snow, and more can address potential safety concerns and reduce the risk of injuries resulting from improper footwear. The present solution can, for example, determine properties of the surface (such as the friction of the surface, reflectivity of the surface, or a hardness of the surface, among others) and adjust a configuration of the shoe from one profile to another. The footwear system described herein can adjust the treads of a sole of the shoe, or the cleat pattern, or a combination thereof to provide a user of the shoe with an improved configuration for the user's current situation. For example, if the user is walking on a sidewalk, the shoe would be configured in a profile with a tread with minimal perforations and greater thickness of a portion of the footwear. In some embodiments, if the sidewalk is or becomes icy or wet, the sole of the shoe can transform to a different profile in different tread configuration. The footwear system described herein can change other portions of the footwear, such as a first or second portion of the footwear, based on profiles configured to provide greater heel, arch, or other such foot support within the footwear. Changes in a configuration of the profile of the shoe may improve the wearer experience, such as by providing increased traction, spring back, balance, or comfort, among others. For example, if the user steps on grass or turf, the shoe can transform to a cleat configuration.

In some embodiments, the user can select a configuration based on the user's intended activity, for example, if the user wants to play soccer on grass, the user can select a configuration that causes the footwear system to deploy cleats at the sole of the shoe. In some embodiments, the user can select the configuration through a device in communication with the shoe or via an interface provided on the shoe. In some embodiments, the user can select the configuration that corresponds to a mode of the footwear. The mode of the footwear can correspond to an intended mobility of the footwear, such as dancing, walking, running, or the mode can correspond to a condition of the surface, such as icy, slippery, sandy, hot, etc.

As described herein, the present solution can transform the profile of the shoe with various methods such as, but not limited to, applying an electric voltage, applying thermal energy, applying magnetic forces, applying a pneumatic force, or other triggering mechanisms for transforming the profile of the shoe.

Turning now to the figures, FIG. 1 illustrates a block diagram of an example footwear system 100. The footwear system 100 can include footwear 105, a database 110, a network 101, a client device 115, or a server 120, among others. The footwear 105 can include one or more portions 125A-N (hereinafter generally referred to as the portion(s) 125), one or more sensors 130A-N (hereinafter generally referred to as the sensors 130), and an actuator 135. The database 110 can include a user record 140 or profiles 145A-N (hereinafter generally referred to as the profile(s) 145), among others. In brief overview, the footwear system 100 may include systems and methods to transform the footwear 105. The actuator 135 can transform the profile 145 associated with a configuration of one or more portions 125 based on a value determined by the sensors 130.

The footwear 105 can be or include an article of footwear and may also be referred to herein as a shoe 105. The shoe 105 can be an apparatus to enclose, encase, or protect at least a part of a foot of a wearer. The shoe 105 can be described in conjunction with a footwear 200 described with reference to FIG. 2. The footwear 105 may be any of a variety of footwear types, including athletic footwear, such as running shoes, basketball shoes, soccer shoes, cross-training shoes, baseball shoes, football shoes, and golf shoes, for example. The footwear 105 may include hiking boots, casual footwear, such as dress shoes, as well as any other kinds of footwear. The footwear 105 can include specialty footwear, such as rollerblades, snowshoes, flippers, or ski boots, among others. Accordingly, the disclosed concepts may be applicable to a wide variety of footwear types. Although a shoe 105 is described, the system depicted herein can be applied to a variety of garments, including gloves, socks, coats, hats, belts, helmets, among others.

In some cases, the footwear 105 may be coupled with or include a database 110. The database 110 can be or include a data repository, a database, a set of databases, a storage medium, or non-transitory memory device(s), among others. The database 110 may include, but is not limited to, electronic, optical, magnetic, or any other storage or transmission device. The database 110 may further include a floppy disk, CD-ROM, DVD, magnetic disk, memory chip, ASIC, FPGA, read-only memory (ROM), random-access memory (RAM), electrically erasable programmable ROM (EEPROM), erasable programmable ROM (EPROM), flash memory, optical media, among others. The database 110 may store information relevant to the footwear system 100, such as a user record 140 or profiles 145A-N. The database 110 may store the information as one or more data structures (e.g., a table, list, mapping, etc.) and in one or more formats (e.g., Comma Separated Values or JavaScript Object Notation, among others). In some cases, the footwear system 100 may not include a database 110. For example, the footwear 105 may not store a user record 140 or profiles 145A-N in the database. In some cases, the profiles 145A-N can be stored in the one or more portions 125 using a material of the one or more portions 125. For example, a shape-memory polymer of the one or more portions 125 can include the profiles 145 corresponding to its material such that the portions 125 are storing the profiles 145, such as via a template or mold disposed within the footwear through which the polymer can extend or retract The database 110 is shown, in this example, as being external to the footwear 105. However, in some implementations, the database 110 may be stored in memory within the footwear 105, for example in a memory chip, board, or other circuit board with memory disposed within the footwear. The database 110 may be coupled with processing circuitry to enable transfer or receipt of information to or from the database. The database 110 may be external to the footwear 105 and may communicate, using the processing circuitry, with the footwear 105 via a network 101. The database 110 may communicate with any of the components of the footwear system 100, including the client device 115, the server 120, or the footwear 105. The contents of the database 110 may be accessed or using one or more application programming interfaces (APIs) or software.

The footwear 105 may include or be coupled with processing circuitry. The processing circuitry can be any hardware or software capable of enabling communications, processing, or management of information throughout the footwear system, such as the value or the determined measurements. The processing circuitry may enable communications between various components of the footwear, such as the portions 125, the sensors 130, or the actuator 135. The processing circuitry may comprise a circuit board, such as a flexible circuit board.

The network 101 can include computer networks such as the Internet, local, wide, metro or other area networks, intranets, satellite networks, other computer networks, such as mobile phone (voice or data) communication networks, or combinations thereof. The footwear 105 of the footwear system 100 can communicate via the network 101 with one or more computing devices, such as the client device 115 or the server 120. The network 101 may be any form of computer network that can relay information between the footwear 105, the database 110, the client device 115, or the server 120, among others. In some implementations, the network 101 may include the Internet and/or other types of data networks, such as a local area network (LAN) (e.g., BlueTooth or BLE), a wide area network (WAN) (e.g., WiFi), a cellular network (e.g., 3G or LTE), a satellite network, or other types of data networks. The network 101 may also include any number of computing devices (e.g., computers, servers, routers, network switches, etc.) that are configured to receive or transmit data within the network 101.

The network 101 may further include any number of hardwired or wireless connections. Any or all of the devices described herein (e.g., the footwear 105, the database 110, the client device 115, or the server 120) may communicate wirelessly (e.g., via Wi-Fi, cellular communication, radio, etc.) with a transceiver that is hardwired (e.g., via a fiber optic cable, a CAT5 cable, etc.) to other devices in the network 101. Any or all of the devices described herein may also communicate wirelessly with the computing devices of the network 101 via a proxy device (e.g., a router, network switch, or gateway). The network 101 can enable communications between a server 120 and the other components of the footwear system 100.

The server 120 can be a computing device remote from the footwear 105 to update information in the database 110, applications operating through the client device 115 as a part of the footwear system 100, or to facilitate any of the computing operations as described herein. The server 120 can be a server system, a cloud-computing platform, a local computing system, a node in a distributed network, a desktop computer, a client device, or any other system that can process information. The server 120 can be or include one or multiple computing nodes, servers, or distributed processing systems.

The server 120 may update the database, including profiles and user records. For example, the server 120 may update a user record 140 based on information received form the user via the client device 115. The server 120 may update the database to add, change, or delete one or more of the profiles 145A-N. In some cases, the server 120 may periodically update the database 110 or the information located therein responsive to a schedule, a request from the footwear 105 or the client device 115, upon a change to the information located in the database 110, among others.

The client device 115 can be any combination of hardware and software to communicate with, update, or access the footwear system 100 by a wearer of the footwear 105. It should be understood that the wearer can be a user who either is wearing the footwear, is capable of wearing the footwear, or is associated with the wearer of the footwear, for example, a parent of the child wearing the footwear. The client device 115 can include at least one processor and a memory (e.g., a processing circuit). The memory can store processor-executable instructions that, when executed by the processor, cause the processor to perform one or more of the operations described herein. The processor can include a microprocessor, an ASIC, an FPGA, a GPU, a TPU, etc., or combinations thereof. The memory can include, but is not limited to, electronic, optical, magnetic, or any other storage or transmission device capable of providing the processor with program instructions. The memory can further include a floppy disk, CD-ROM, DVD, magnetic disk, memory chip, ASIC, FPGA, ROM, RAM, EEPROM, EPROM, flash memory, optical media, or any other suitable memory from which the processor can read instructions. The instructions can include code from any suitable computer programming language. The client device 115 can include one or more computing devices or servers that can perform various operations as described herein.

The client device 115 can be a personal computer, a laptop computer, a television device, a smart phone device, a smart watch, a mobile device, smart glasses, other wearables, or another type of computing device. The client device 115 can include a display or display portion. The display can include a display portion of a television, a display portion of a computing device, or another type of interactive display (e.g., a touchscreen, etc.). The client device 115 may include one or more I/O devices (e.g., a mouse, a keyboard, digital keypad, buttons, trackpads, touch sensor of the touchscreen, etc.). The display can include a touch screen displaying an application, such as a web browser application or a native application, which may be used to access the functionality of the database 110, the footwear 105, the server 120, or the network 101, as described herein.

The client device 115 can receive interactions from a wearer of the footwear 105. The client device 115 may also receive interactions via any other type of I/O device. The interactions can result in interaction data, which can be stored and transmitted by the processing circuitry of the client device 115. The interaction data can include, for example, interaction coordinates, an interaction type (e.g., drag, click, swipe, scroll, tap, etc.), and an indication of an actionable object (e.g., an interactive user-interface element, such as a button, hyperlink, etc.) with which the interaction occurred. The interaction data can identify a user-interface element with which the interaction occurred. The interaction data can identify a time of interaction or settings for a configuration of the footwear 105. For example, the interaction data may identify a preferred profile 145 for the configuration of the portions 125.

The client device 115 can include or be identified by a device identifier. The device identifier can include a script, code, label, or marker that identifies a particular client device 115. In some implementations, the device identifier can include a string or plurality of numbers, letters, characters, or any combination of numbers, letters, and characters. In some cases, the client device 115 can be associated with or identified by a user record 140.

The user record 140 can be or include a profile, account, or file identifying the wearer of the footwear 105. In some cases, input from the wearer of the footwear 105 to the client device 115 associated with the wearer can be stored in the user record 140 in the database 110. In some cases, operations performed by the footwear 105 (such as identifying a value of a surface, historical configurations of the profiles 145, timestamps of various operations, among others) can be stored in the user record 140.

The client device 115 can include a client application, which can be a web browser or a native application that communicates with the footwear 105 to submit user settings, initiate a change to a configuration of the profile for the portions 125, or other functionality described herein. The application can include a web application, a server application, a resource, a desktop, or a file. The application can include a local application (e.g., local to a client device 115), hosted application, a SaaS application, a virtual application, a mobile application, or other forms of content. In some implementations, the application can include or correspond to applications provided by remote servers or third-party servers. The application may generate or otherwise present one or more interactive user-interface elements, include user-selectable hyperlinks, buttons, graphics, videos, images, or other interactive elements to control the functionality of the application or provide input to the database 110 or the footwear 105. Interactions with such interactive user-interface elements (sometimes referred to as "actionable objects") can cause the application executing on the respective client device 115 to generate a signal, which can cause the application to perform further operations corresponding to the actionable object.

In some implementations, the client device 115 can establish a communication session with the footwear 105. A communication session can include a channel or connection between the footwear 105 and a respective client device 115. The one or more communication sessions can each include an application session (e.g., virtual application), an execution session, a desktop session, a hosted desktop session, a terminal services session, a browser session, a remote desktop session, a URL session or a remote application session. Each communication session can include encrypted or secure sessions, which can include encrypted files, data, or traffic. The session may be established based on information of a user record 140 of a wearer of the footwear 105.

In some implementations, the client device 115 may execute a notification module. The notification module can operate on the client device 115, the footwear 105, or another component of the system 100 to provide notifications or alerts to the wearer of the footwear 105 of a transformation of the configuration of the footwear from a first profile to a second profile. In some embodiments, the notification module can generate, responsive to an indication by the footwear 105, an alert. The notification module can generate instructions to present the alert comprising an indication of transformation to the wearer of the footwear 105 via the client device 115. For example, the client device 115 and the footwear 105 may be in communication and the footwear 105 may provide an indication to the client device 115 that the footwear 105 is changing or will change. The client device 115 may present the alert to the wearer of the shoe via the client device 115 to warn or alert the wearer of the transformation via a display of the client device 115, a speaker of the client device 115, or through haptic feedback via the client device 115. For example, the client device may emit a sound, vibration, or present a user interface alerting the wearer of the transformation upon the footwear 105 transforming. In some cases, the notification module can generate instructions to actuate an alert from the footwear 105. For example, the notification module can generate a sound to play via a speaker device coupled with the shoe, such as a beep, chime, or other noise to indicate to the wearer that the shoe is transforming. For example, the notification module can generate haptic feedback within the shoe (via, for example, a motor disposed within the footwear 105) to alert the wearer that the shoe is transforming.

The footwear 105 can include one or more portions 125. The portions 125 can be or include sections of the footwear 105, such as a sole of the footwear, a midsection of the footwear, a heel of the footwear, a tongue of the footwear, an insole of the footwear, or a combination thereof as described herein. A portion of the portions 125 can be delineated based on a coupling point or line (e.g., a portion 125 defined by stitching, adhesive, or another coupling mechanism), a type of material (e.g., a first portion 125A can be sections of the footwear 105 made of leather and a second portion 125B can be a section made of rubber), function (e.g., a sole of the footwear 105 designed to encounter the surface can be a first portion 125A and an upper portion configured to receive the foot of the wearer can be a second portion 125B), among others.

The portions can be configured in one of the profiles 145. The profiles 145 can be stored in the database 110, as a portion 215 of the footwear 105, the client device 115, or the server 120. The profile 145 can refer to a shape, extrusion, pattern, length, or overall physical configuration of at least one of the one or more portions 125. For example, the profile 145 can refer to a configuration of cleats on a sole of the footwear 105 (e.g., a first profile 145A corresponding to cleats in a pattern, height, and rigidity corresponding to playing soccer vs. a second profile 145B corresponding to cleats in a pattern, height, and rigidity corresponding to playing football). For example, the profile 145 can refer to shape, height, or hardness of a heel of a the footwear 105. For example, the profile 145 can refer to a length of a portion 125 including an ankle of the footwear 105 (e.g., a first profile 145A corresponding to a "low-top" shoe vs. a second profile 145B corresponding to a "high-top" shoe or boot).

The profile 145 can include one or more protrusions. In some cases, the one or more portions can include a sole of the footwear 105, as described herein. The sole may include one or more protrusions extending away from the footwear 105. In some cases, the protrusions may extend such that they make contact with the surface instead of or prior to other of the portions 125, including the sole without the protrusions. The protrusions can be or include at least cleats, treads, heels, spurs, or wedges. The protrusions can have dimensions, such as a height (e.g., length), diameter, width (e.g., perpendicular to a long axis of the footwear), or depth (e.g., parallel to a long axis of the footwear or parallel to a gait of the wearer of the footwear 105).

The profile 145 can include the one or more protrusions at a specified length. Each profile of the profiles 145 can define a length for each protrusion of the portions 125. For example, a first profile 145A may correspond to or include a five-inch tall stiletto heel vs. a second profile 145B corresponding to a 0.5-inch tall inch kitten heel. In some cases, the profile may define a length of 0 for one or more of the protrusions. A length of 0 can correspond to a protrusion which is flush with the sole of the shoe without protrusions.

The profile can include a pattern of the protrusions. The pattern of the protrusions can define a layout of the protrusions, such as where on a plane defined by the sole each protrusion extends from. In this manner, the pattern of the protrusions can refer to or include a sole pattern. The pattern can be any visual pattern, such as a grid, zigzags, stripes, or any other arrangement or layout of the protrusions. The pattern can define a length for each protrusion at each protrusion's location of the pattern. For example, a first protrusion extended from a first location of the pattern may have a first length different or the same as a second protrusion extended from a second location having a second length.

The profile 145 including the sole patterns can include a rigidity of each protrusion. For example, a sole pattern may define a first subset of protrusions associated with a first profile 145A to have a first hardness and a second subset of protrusions associated with the first profile 145A to have a second hardness different than the first hardness. The profile 145 including the sole patterns can include a shape of each protrusion. The protrusions may include shapes such as cylinders, spikes, wedges, cleats, treads, among other shapes.

The pattern can include or define a number of the protrusions. For example, a first pattern included in a first profile 145A can include a set number of protrusions of varying sizes, heights, shapes, and locations. A second pattern included in a second profile 145B can include a second set number of protrusions of varying sizes, heights, shapes, and locations. In this manner, a profile can define a length, pattern, shape, dimension, or number of protrusions. Each protrusion for a profile 145 can have a different attributes such as hardness, length, size, dimension, location, shape, or diameter, among others. Furthermore, each profile 145 can have different protrusions with the different attributes.

The portions 125 can include one or more systems to facilitate a transformation of at least one of the portions. The portions 125 can include one or more subsystems, such as a shape memory polymer, a magnetic system, a micro-electromechanical system (MEMS), a thermal printer, or a pneumatic system. Each system included in the portions 125 can be actuated to change the configuration from a first profile 145A to a second profile 145B responsive to at least one of the portions 125 contacting a surface.

At least one of the one or more portions 125 can be in contact with a surface. The at least one portion can be in contact such as rubbing, exerting pressure on, or otherwise touching the surface. For example, a sole of the footwear 105 can be in contact with the surface including a floor when the wearer is wearing the footwear and standing on the floor. For example, a toe of the footwear 105 can be in contact with a surface upon an item falling onto a toe of the footwear 105.

The surface can be or include a variety of environments or objects with which at least one portion of the one or more portions comes into physical contact. For example, the surface can include a ground, such as carpet, tile, asphalt, linoleum, or concrete. The surface can include natural materials, such as grass, dirt, wood, mud, or water. The surface can include objects which come into contact with at least one portion of the footwear 105, such as a ball, furniture, a dropped object (e.g., a hammer, utensil, etc.), among others. Each surface can include a variety of attributes. The attributes can describe the surface or a condition of the surface. For example, the attributes can include a hardness of the surface, a wet or dryness of the surface, a color of the surface, a material of the surface, a friction of the surface, among other such attributes.

The one or more sensors 130 can include any combination of hardware or software to determine the one or more attributes of the surface to determine a value based on the surface. The sensors 130 can include sensors to determine measurements relating to the attributes of the surface. In some cases, the sensors 130 can include sensors to measure the hardness or resistance to deformation of the surface, such as a durometer. A durometer or other hardness sensor 130 can determine a value of hardness of the surface at a point of contact between the hardness sensor and the surface. In some cases, the sensors 130 can include sensors to measure a moisture content of the surface, such as a capacitive sensor, tension meter, or conductivity sensor, among others. In some cases, the sensors 130 can include thermometers to measure a temperature of the surface. In some cases, the sensors 130 can include optical sensors to measure a reflectivity of the surface.

The sensors 130 can determine measurements including the footwear 105 and the surface to determine the value. In some cases, the sensors 130 can include sensors to measure a friction between the surface and the at least one portion in contact with the surface, such as a tribometer or force sensors. In some cases, the sensors 130 can include sensors to measure a contact pressure between the surface and the at least one portion in contact with the surface, such as tactile sensor. In some cases, the sensors 130 can include sensors to measure a slip, or difference in velocity, frequency, or speed, between the surface and the at least one portion in contact with the surface. Sensors to measure slip can include accelerometers, traction control sensors, strain gauges, among others.

The sensors 130 can determine measurements for the footwear 105. The sensors can include accelerometers, velocity sensors, gyroscopes, or other such sensors to measure movements of the footwear 105, such as speed, acceleration, rotation, etc. In some cases, the sensors 130 can include sensors inertial measurement units to provide comprehensive motion sensing capabilities.

The sensors can determine one or more values based on the measurements. The sensors 130 may calculate the values in a variety of ways from the measurements. One of the values can be related to the surface in contact with at least one of the one or more portions 125. The sensors 130 may determine the values related to the surface by performing operations on the measurements related to the surface or to the surface and the footwear 105, as described herein. For example, the sensors 130 may add, multiple, or perform another mathematical operation on each of the measurements gathered related to the surface to generate a value based on the surface in contact with the at least one of the one or more portions 125. As an illustrative example, the sensors 130 may use a measurement related to a moisture of the surface, a hardness of the surface, and a temperature of the surface to determine a value corresponding to the surface. The sensors 130 may map the measurements according to a value index to determine the value corresponding to the surface in contact with the at least one of the one or more portions 125. For example, a first measurement can be within a first range, a second measurement can be within a second range, and a third measurement can be within a third range. The sensors 130 can determine, based on a mapping of the ranges of the measurements to a value, the value related to the surface in contact with at least one of the one or more portions.

In some cases, the value can be determined based at least on a temperature measurement of the surface in contact with the footwear 105. For example, a sole of the footwear 105 may be exposed to a temperature of a surface such that the sensors 130 determine a value corresponding to the temperature of the surface. The value corresponding to the temperature of the surface may be determined to be at or above a threshold value for temperature.

One of the values can be based on a movement of the one or more portions. In some cases, the sensors 130 can perform operations to determine a value based on the movement of the one or more portions 125. For example, a wearer running and jumping while wearing the footwear 105 may cause the sensors 130 to determine a particular speed, acceleration, rotation, or other movement. The sensors 130 may determine a value corresponding to the movement based on the measurements relating to the movement, as described herein. The sensors may determine the measurements periodically, such as according to a schedule, or periodically. In some cases, the sensors may determine the one or more values after the elapse of a threshold period of time. For example, the sensors may determine that one or more measurements has changed beyond a threshold amount, and may delay determining a new value for a threshold period of time upon determining the change within the measurements. This delay may enable the footwear system 100 from exhibiting jitter, or from transforming prematurely.

In some cases, the sensors 130 can determine a value corresponding to a second surface in contact with at least one of the one or more portions 125 subsequent to or concurrently with the determination of the value corresponding to a first surface. In some cases, the wearer of the shoe 105 may step on a different type of surface while walking, running, playing sports, or performing other movements. For example, the wearer may walk from a lawn to a tile porch. The sensors 130 may determine a second value corresponding to the second surface upon the footwear coming into a contact with the second surface. In this manner, the footwear system 100 can continuously monitor for and change the configuration of the profile 145 of the shoe 105 in accordance with different surfaces.

Upon a determination of the value based on the surface in contact with at least one of the one or more portions 125, the actuator 135 may change a configuration of the profile 145. The actuator 135 can be or include any combination of hardware or software to change a configuration of the profile 145 responsive to the determination of the value. The actuator 135 can interact with systems and components of the portions 125, including a pneumatic system, a shape memory polymer, a magnetic system, a MEMS, or a thermal printer, among others. In some cases, the actuator 135 can cause the one or more systems of the portions 125 to change the configuration of the one or more portions from a first profile 145A to a second profile 145B.

In some cases, the actuator 135 may include a control system including processing circuitry that determines whether the value satisfies a profile configuration condition. A profile configuration condition can be or include one or more thresholds, rules, or parameters for each profile 145. In some cases, each profile of the profiles 145 can correspond to a profile configuration condition. The profile configuration condition can include one or more thresholds corresponding to the value determined by the sensors 130. The profile configuration condition can include a mapping of the value to one or more of the profiles 145. In some cases, the profile configuration condition can correspond to the value based on the surface, the value based on the movement of the footwear 105, or a combination thereof. For example, a first profile configuration condition may correspond to measurements taken by the sensors 130 each within a threshold range. The actuator 135 can determine, using the processing circuitry of the control system, if the one or more values satisfies the profile configuration condition. For example, the processing circuitry can determine if the value maps to a profile configuration condition, based on an index mapping values to profile configuration conditions for each profile 145. For example, the processing circuitry can determine if the value maps to a profile configuration condition based on the value satisfying one or more thresholds associated with the profile configuration condition.

In some cases, the value may not satisfy any profile configuration condition. The actuator 135 can determine, via the processing circuitry of the control system, to remain with its current profile 145 based on the value not satisfying any profile configuration condition. In some cases, the wearer can input, via the client device 115, an override to change the configuration of the footwear 105 from a first profile to a second profile upon the actuator determining to remain with its current profile.

In some cases, the value may satisfy a profile configuration condition. The actuator 135 may change the configuration of the profile 145 from a first profile to a second profile upon determining that the value satisfies the configuration condition for the second profile. In some cases, the actuator may select a profile from the profiles 145 based on the value. The value may satisfy a configuration condition corresponding to a profile of the profiles. The actuator 135 may select the profile which corresponds to the satisfied configuration condition. The actuator 135 may change the configuration of the profile 145 by actuating one or more systems of the portions 125.

As an illustrative example, the value may correspond to a temperature of the surface in contact with the at least one portions. The actuator may determine, via the processing circuitry of the control system, that the value is at or above a threshold value corresponding to the temperature of a surface. The threshold value corresponding to the temperature of a surface can be a part of a profile configuration. Upon determination that the value is at or above the threshold value for the profile configuration, the actuator may transform the at least one portion to be thicker, include ventilation holes, or other such means to protect the foot from excess heat of the surface.

As an illustrative example, the value may correspond to a movement of the shoe. The one or more sensors 130 may determine a value of slip between the surface and the footwear 105 and/or a change in pressures exerted in locations within the footwear 105 by the foot of the wearer which indicate a change in direction, an acceleration, or other such changes in movement. The value may indicate a profile configuration based on the detections indicating a predicted sudden movement of the shoe, such as to reduce slip, increase friction, or otherwise provide more grip for the footwear upon a sudden acceleration or jerk. In this example, the actuator 135 may cause one or more protrusions or cleats to emerge, lengthen, or appear to enable greater traction for the wearer upon the detection of the sudden acceleration.

The actuator may expand at least one portion of the one or more portions 125 to change the configuration of the one or more portions from a first profile 145A to a second profile 145B. The actuator 135 may expand the one or more portions 125 conforming to the first profile 145A in any direction, such as a height of the profile, width of the profile, or length of the profile to change the one or more portions 125 to conform to the second profile 145B. The actuator 135 may expand the at least one portion longitudinally, laterally, or a combination thereof. For example, the actuator 135 may cause one or more protrusions of the sole to expand or retract in length, diameter, hardness, or other qualities.

The actuator 135 may change a shape of the portions 125 including the protrusions. In some cases, the actuator 135 may change a shape of the protrusions responsive to determining that the value satisfies the profile configuration condition. For example, the actuator 135 may cause the shape of a protrusion to change from a first shape to a second shape, such as from a cylinder-like shape to a spike-like shape, or from flat (e.g., a protrusion with a length of 0) to a cube-like shape. The actuator 135 may change a pattern of the portions 125. For example, the actuator 135 may cause one or more protrusions to protrude from the sole or recede towards the sole in one or more different locations from the first profile 145A to the second profile 145B.

The actuator 135 may generate or manipulate an electric stimulation to change the one or more portions 125. In some cases, the actuator 135 can be coupled with one or more energy sources, such as a battery pack, battery cells, photovoltaic cell, alternator, or other means by which to produce the electric stimulation. The electric stimulation can include electrical energy, current, voltage, or electromagnetism, among others. The actuator 135 may produce the electrical stimulation in any quantity, amplitude, or period, such as a direct current (DC), alternating current (AC), pulse-width modulation (PWM), among others. In some cases, the electric stimulus can produce heat or magnetism. For example, current produced by the actuator 135 can cause heat to actuate the one or more portions 125 from a first profile to a second profile. For example, an electric stimulation generated by the actuator 135 can induce eddy currents within the footwear 105 to produce a magnetic field.

Figure 2A:
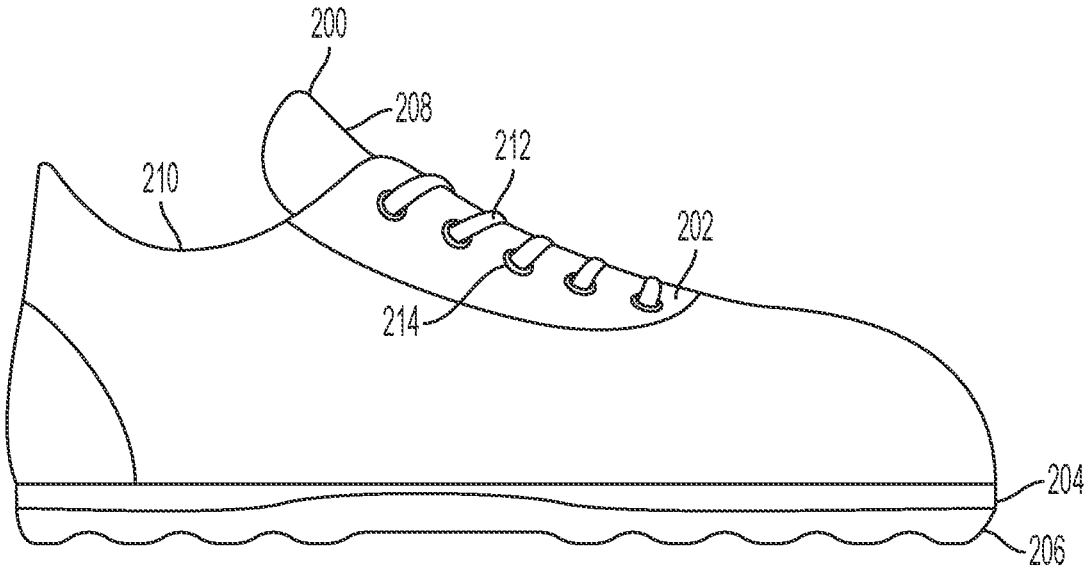
FIG. 2A illustrates a side view of an article of footwear, including portions for a transformable sole.
Figure 2B:
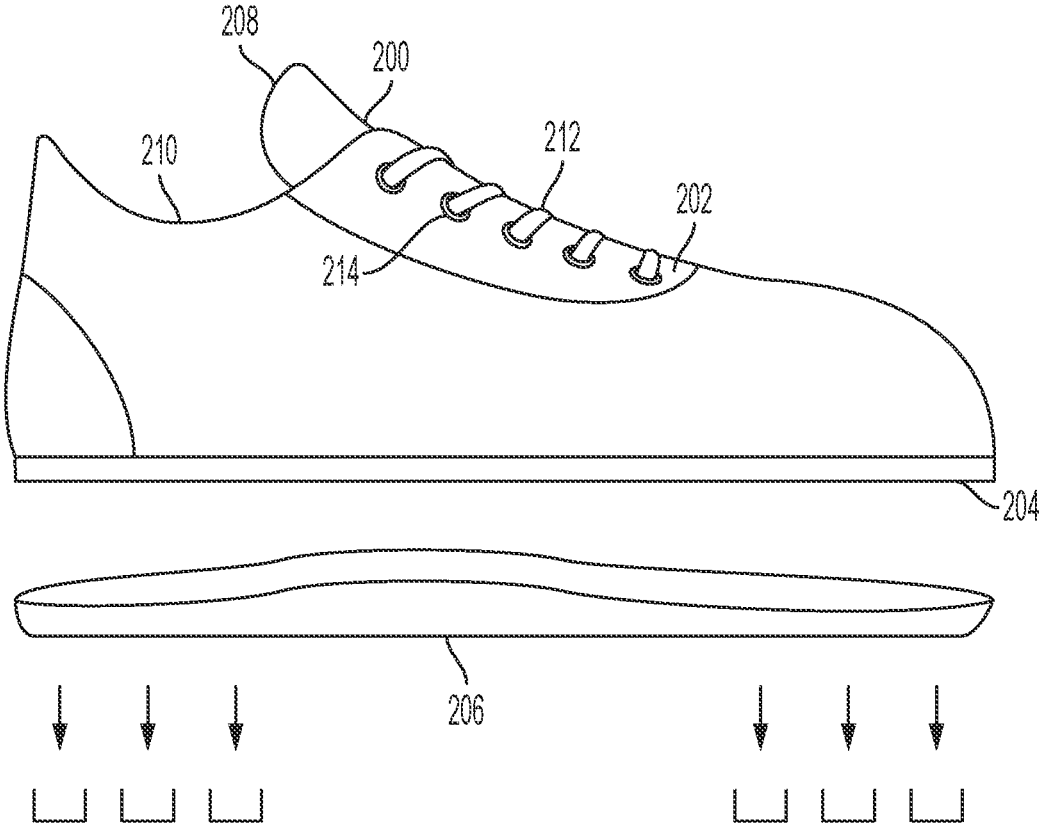
FIG. 2B illustrates a side view of an article of footwear exhibiting an example method of sole transformation.

FIG. 2A illustrates a side view of an article of footwear 200 including an upper, or first portion 202, a midlayer, or second portion 204, and a sole, or third portion 206. The footwear 200 can be like or include the footwear 105 of FIG. 1. As shown in FIG. 2A, footwear 200 may include the upper 202, secured to the midlayer 204, secured to the sole 206. The upper 202, the midlayer 204, and the sole 206 may each be a portion of the portions 125. The upper 202, the midlayer 204, and the sole 206 may each include one or more portions 125. For example, the upper 202 can include a tongue 208 as a portion 125. The sole 206 may be fixedly attached to midlayer 204 (for example, with adhesive, stitching, electrical bonding, soldering, chemical bonding, electrochemical bonding, magnetic bonding, welding, or other suitable techniques) and may have a configuration that extends between midlayer 204 and the ground, such as the surface described with reference to FIG. 1. In some embodiments, the sole 206 is secured directly to the upper 202 in methods outlined above, without the use of midlayer 204. Third portion 206 may include provisions for attenuating ground reaction forces (that is, cushioning and stabilizing the foot during vertical and horizontal loading). In addition, third portion 206 may be configured to provide traction, impart stability, and control or limit various foot motions, such as pronation, supination, or other motions. For example, to aid in climbing or hiking, the third portion 206 may be configured to help with or enhance dorsiflexion. For example, to aid in jumping, the third portion 206 may be configured to help with or enhance plantar flexion. For example, to aid in lateral movements, the third portion 206 may be configured to further stabilize the ankle with aversion or eversion.

The configuration of the sole 206 may vary significantly according to one or more types of ground surfaces that sole 206 may be used. For example, the disclosed concepts may be applicable to footwear configured for use on any variety of surfaces, including indoor surfaces or outdoor surfaces. The configuration of the sole 206 may vary based on the properties and conditions of the surfaces on which footwear 200 is anticipated to be used. For example, the actuator 135 may transform the sole 206 depending on whether the surface is harder or softer, such as determined by the sensors 130 for the value based on the surface in contact with at least one of the one or more portions 125. In another example, the sole 206 may transform based on a sensed coefficient of friction. In addition, the sole 206 may be tailored for use in wet or dry conditions.

The midlayer 204 may reside between the sole 206 and the upper 202. The midlayer 204 may be subsumed by sole 206 or upper 202, or the midlayer 204 may extend fully. The midlayer 204 may be comprised of multiple layers. For example, the midlayer 204 may include a first layer in a first material and dimensions and a second layer in a second material and dimension. One or more layers of the midlayer 205 can store, for example, a polymer to effect a transformation of the footwear from a first profile to a second profile. In some cases, one or more layers of the midlayer 205 can store preconfigured cleat forms, such as a template, cutouts, or manufactured forms which enable a layer comprising polymer to extend through to form the one or more protrusions. The midlayer 204 may be affixed to sole 206 and upper 202.

The upper 202 may include one or more material elements (for example, meshes, textiles, foam, leather, synthetic leather, or synthetic nanomaterials), which may be joined to define an interior void 210 configured to receive a foot of a wearer. The upper 202 may also include a tongue 208 for ensuring fit of the shoe. Ensuring fit of the shoe can include adjusting the footwear based on variations in structure of a foot to enable comfort of the foot disposed within the footwear. For example, a foot of the wearer may benefit from more arch support such that the midlayer 205 may extend to fill in a gap between the foot and a portion of the shoe, or the upper may compress or tighten as to securely enclose the foot within the footwear. The upper 202 may also include a securing mechanism 212 for securing the footwear onto the user. Securing mechanism 212 may include, but is not limited to, Velcro, shoe laces, elastic straps, or ribbon. Securing mechanism 212 may utilize eyelets 214. The securing mechanism can include magnetic or preform bindings or fittings.

Referring now to FIG. 1B, which illustrates a side view of an article of footwear exhibiting an example method of sole transformation. The sole 206 may be a transformable sole. Sole 206 may be comprised of a single material or a variety of materials. These materials can include, but are not limited to, rubber, leather, metals, polymers, foam, nano-ferrous materials, or nitinol. These materials can be configured to transform. As shown in FIG. 1B, the sole 206 may be able to change a profile or shape. The sole 206 may have multiple different configurations, for example, different tread configurations, cleat configurations or a mix of tread and cleat configurations. The sole 206 may include multiple components, which may individually or collectively provide footwear 200 with a number of attributes, such as support, rigidity, flexibility, stability, cushioning, comfort, reduced weight, increased traction control, surface select ability, or other attributes.

In some embodiments, sole 206 is attached to midlayer 204, which is attached to upper 202. In other embodiments, the upper 202 includes a securing mechanism 212 and eyelets 214. In some other embodiments, the upper 202 contains an opening 210 into which a wearer can insert his or her foot. In some other embodiments, the upper 202 includes a tongue 208.

Figure 2C:
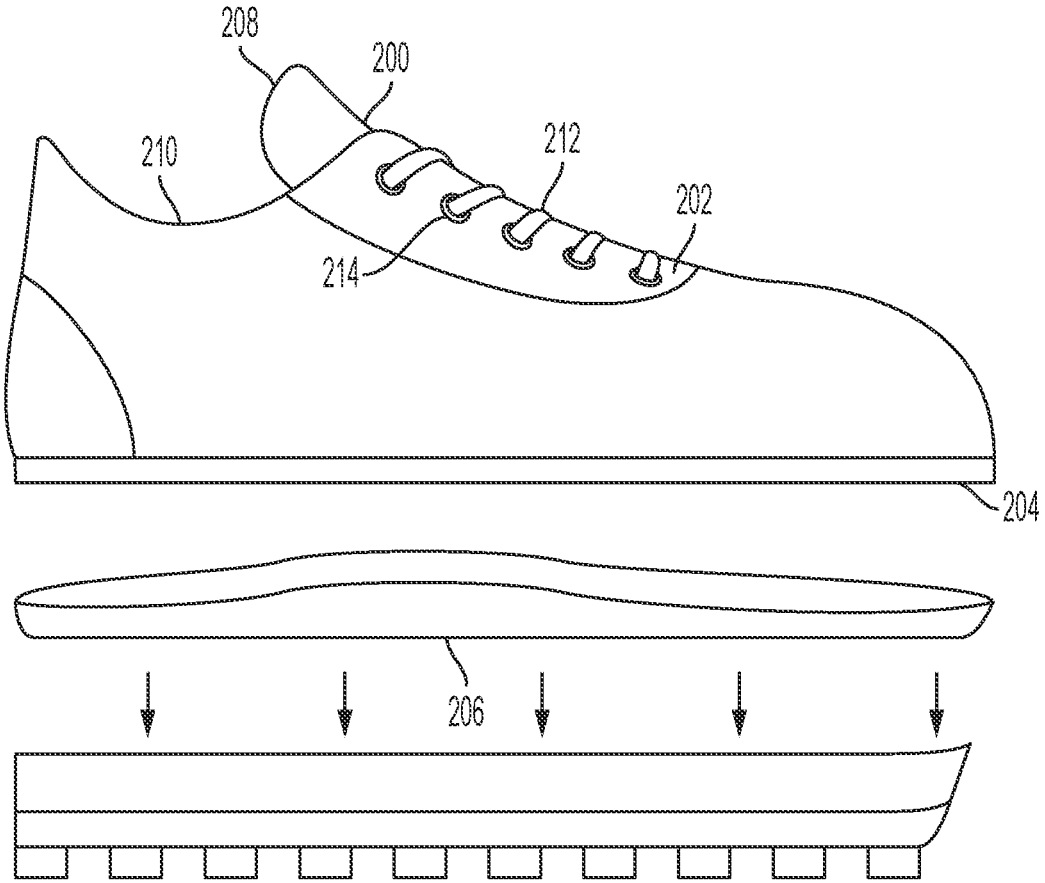
FIG. 2C illustrates a side view of an article of footwear exhibiting another example method of sole transformation.

FIG. 2C illustrates another example of a side view of an article of footwear exhibiting an example method of sole transformation. The sole 206 may be able to change to a variety of profile configurations, such as the profiles 145 described with reference to FIG. 1. As shown in FIG. 2C, the sole 206 can change from a flat bottom to a shoe with cleats. That is to say, the actuator 135 can cause protrusions of a second length to form on the sole based on a change from the first profile to the second profile. This is not intended to limit the functionality of sole 206, which in other embodiments can transform profile heights in a variety of ways. For instance, the sole may include a plurality of treads and the shape or height of each tread can be adjusted to create a different sole profile. In some embodiments, the shoe may be designed to have a plurality of pre-configured sole configurations, which can include one or more tread configurations and/or cleat configurations, and the shoe can be configured to transform the sole from a first sole configuration to a second sole configuration. In some embodiments, the shoe can be configured to select the desired sole configuration from the plurality of sole configurations. In some embodiments, the shoe can be configured to select the desired sole configuration based on sensor data and then cause the sole to transform to the selected sole configuration using actuators embedded or disposed within the shoe, as described herein.

FIG. 2C also shows the midlayer 204 of the shoe 200, as well as the upper 202. The upper 202 can comprise a securing mechanism 212, as well as eyelets 214 for use with the securing mechanism 212. The upper 202 can also contain an opening 210 for insertion of the wearer's foot into the footwear 200.

Figure 3B:
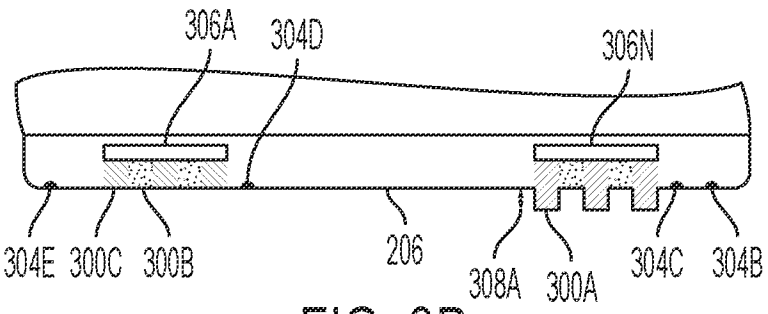
FIG. 3B illustrates a side view of an undeployed transformable tread sole, according to an embodiment.
Figure 3C:
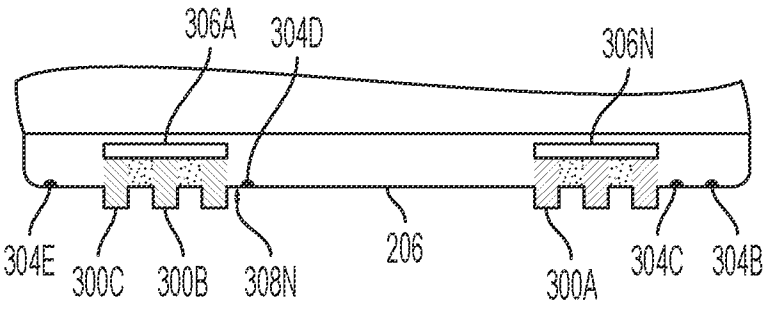
FIG. 3C illustrates a side view of a deployed transformable tread sole, according to an embodiment.
Figure 3A:
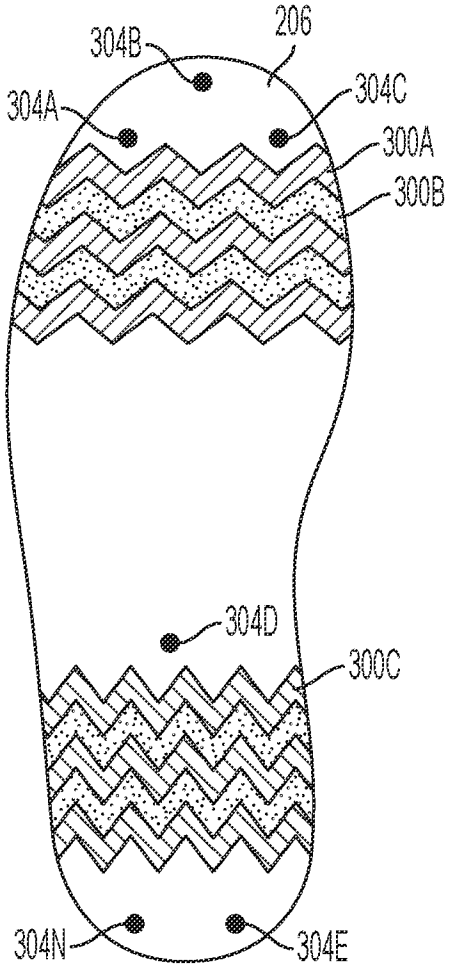
FIG. 3A illustrates a bottom view of an example of a sole with transformable treads, according to an embodiment.

FIG. 3A-3C illustrate an example of the sole 206 with transformable treads, according to an embodiment. FIG. 3A shows a bottom view of the sole 206, FIG. 3B shows a side view of an example tread configuration, such as corresponding to one of the profiles 145, and FIG. 3C shows a side view of an example tread configuration transformation. As shown in FIGS. 3A-3C, the sole 206 may include a first plurality of sensors 304 configured to sense, detect, measure, or identify an attribute of the ground beneath the wearer's feet. The sensors 304 can be one of a plurality of sensors. The sensors 304 can be or include the sensors 130. In some embodiments, the sensors 304 are friction sensors. In other embodiments the sensors 304 are light sensors. In still other embodiments, the sensors can be pressure sensors. In yet another embodiment, the sensors can be accelerometers.

FIGS. 3A-3C show the sensors 304 in an example configuration. The sensors 304 may be arranged in a plurality of ways along the sole 206 of the shoe. The sensors can be arranged to enable the shoe to detect the surface below, or in contact with, the shoe. The sensors 304 can be arranged as to determine an attribute of a user's foot or movement, such as a pressure exerted by the foot or a speed of the foot within the footwear. The sensors can be arranged such that they can interact with the bottom of the sole 206 and internal components of the shoe, such as an actuator 306.

In some cases, the sensors 304 may be arranged based on the type of the sensors 304. Each type of sensors 304 may be located to enable the type o the sensor 304 to determine a measurement or the value. For example, a sensor 304 to determine an attribute of light of the surface or the area around the footwear may be located on a protrusion or other area of the sole 206 such that the light sensor does not make contact with the surface. In this manner, the light sensor 304 may gather light measurements without light being obstructed by the surface. As another illustrative example, a sensor 304 to determine pressure exerted on the footwear by the surface may be located on a protrusion of the footwear at a point in contact with the surface. Similarly, a sensor 304 to determine pressure exerted on the footwear by the wearer of the footwear may be located within a cavity of the shoe, such as at an insole or heel, to determine pressure exerted by various contractions or forces of the foot of the wearer. As another illustrative example, a sensor 304 to determine friction forces between the footwear and the surface can be located at a point of the sole 204 in contact with the surface, such as a point on a protrusion.

The actuator 306 can be configured to transform physical components of the shoe. In some embodiments, the actuator can be configured to change a height 308 of the treads 300. For example, the actuator 306 may change the height 308 of the treads from 0.5 mm to 2.5 cm. In some embodiments, the actuator controls a plurality of polymerized treads 300. In some embodiments, the actuator controls the height 308 of the treads 300 responsive to a change in input determined by the sensors 304. For example, if the sensors 304 determine a change in an attribute of the surface greater than 5% of a previous detected measurement, processing circuitry of the system may determine or select a profile for the actuator to transform the shoe to. The actuator 306 can be one of a plurality of actuators. The plurality of actuators can comprise pneumatic actuators, thermal actuators, electrical actuators, magnetic actuators, or another example of actuator. Additional details regarding these actuators are provided below.

The treads 300 can be comprised of a plurality of materials or layers. In some embodiments, the treads 300 are comprised of a transformable material or matter, such as a polymer. In some embodiments, this polymer reacts to changes in heat, electric field, pressure, magnetism, or another stimulus. In some embodiments, the treads 300 including the polymer can transform into treads of varying heights and configurations based on changes to the polymer responsive to application of an external source. Additives can be combined with the polymers in order to provide certain functionality applicable for soles. In some embodiments, the polymer or another material such as a ferrofluid can be contained within a chamber that can be actuated in order to transform the sole. In some cases, the chamber can be disposed within one of the one or more portions 125. The chamber can be defined by an outer layer that forms the surface of the sole. The outer layer can be made from a material that is durable and does not easily get worn out by repetitive contact with the ground. Additional details of how the treads can be transformed are provided below, with respect to FIGS. 4, 5, and 6. In some embodiments, the transformable matter can be a gel that allows for a mechanochemical reaction that can transform properties of the gel to conform to a particular shape or profile.

The chamber may contain a ferrofluid. The ferrofluid may be a fluid with nanoscale ferromagnetic particles suspended within it, such as those sold by CMS magnetics or Montreal Magnets. Magnetic points may be strategically placed around the chamber such that the actuation of the magnets causes a protrusion in the sole of the shoe. In this manner, the protrusions can be or include magnetic protrusions. The actuation may be caused by a magnetic actuator creating a magnetic field in desirable locations of the shoe. For example, the actuator 135 may generate the electric stimulation to create a magnetic field to actuate one or more magnets to change a configuration of the profile 145 of the shoe 105. The actuator 135 may actuate the magnetic field by providing the electric field such that the magnetic points are within the magnetic field and at such a strength as to cause the magnets located at the magnetic points to expand, extrude, or otherwise to conform to a second profile 145B. In this manner, the actuator 135 can apply the electric stimulation to the magnetic protrusions to cause them to change from a first profile to a second profile, including changing from a first length to a second length or changing a pattern of the sole.

Figure 3E:
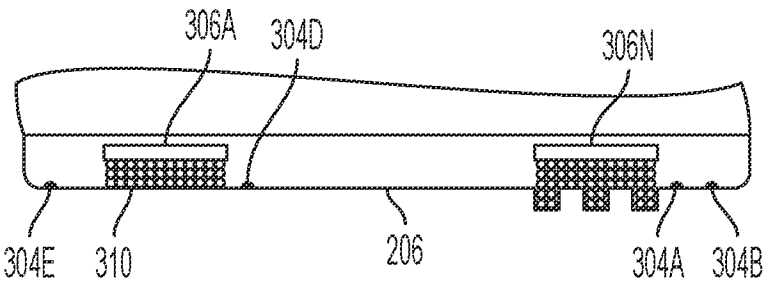
FIG. 3E illustrates a side view of an undeployed transformable cleat sole, according to an embodiment.
Figure 3F:
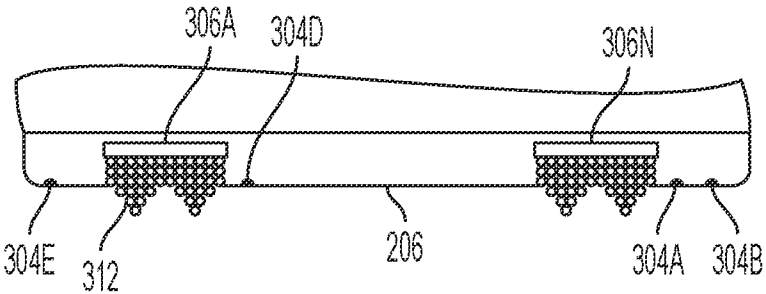
FIG. 3F illustrates a side view of a deployed transformable cleat sole, according to an embodiment.
Figure 3D:
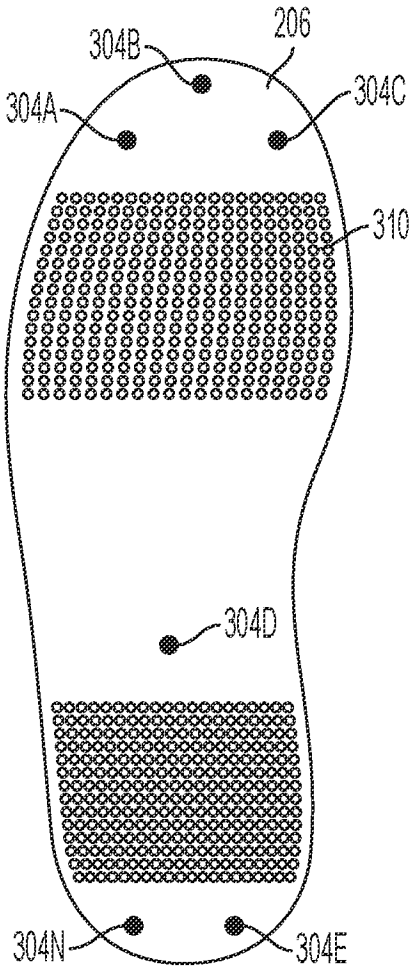
FIG. 3D illustrates a bottom view of an example of a sole with transformable cleats, according to an embodiment.

FIGS. 3D-3F illustrate an example of a sole with transformable cleats, according to an embodiment. FIG. 3D shows a bottom view of the sole 206, FIG. 3E shows a side view of an example cleat configurations, and FIG. 3F shows a side view of an example cleat transformation configuration. The sensors 304 can be one of a plurality of sensors. The sensors 304 can be like or include the sensors 130 as described with reference to FIG. 1. In some embodiments, the sensors 304 are friction sensors, in other embodiments the sensors 304 are light sensors. Examples of friction sensors include tribosensors, as discussed in publications from the IEEE. In still other embodiments, the sensors can be pressure sensors. In yet another embodiment, the sensors can be accelerometers.

FIG. 3D shows the sensors 304 in an example configuration. The sensors 304 may be arranged in a plurality of locations along the sole 206 of the shoe. The sensors 304 can be arranged for optimal detection of the surface below the shoe. The sensors 304 can be arranged such that they can interact with the bottom of the sole 206 and internal components of the shoe, such as an actuator 306. The sensors may include any form of electronic circuitry to perform operations as described herein and to communicate with other components of the footwear 105, such as the actuator 306 or the portions 125. For example, the sensors 304 may include wiring or communications circuitry including a transponder, transistors, transmitters, or receivers to communicate with other components of the footwear 105. The actuator 306 can exist in pluralities and several embodiments. The actuator 306 can be like or include the actuator 135 and can serve to transform physical components of the shoe, such as cleat height or hardness.

In some embodiments, the actuator 306 can be configured to change properties of a material 310 to form a cleat 312 or a protrusion that functions as a cleat. The material 310 may include a transformable material, such as a polymer configured to react to a change in voltage, magnetism, pressure, electricity, or some other stimulus. In some cases, the polymer can be a shape-memory polymer, configured to change shape between two or more profiles upon application of an electrical stimulation. In some embodiments, the polymer or another material can be contained within a chamber that can be actuated in order to transform the sole. Additional details of how the treads can be transformed are provided below, with respect to FIGS. 3, 4, and 5.

The polymer 310 may transform into a cleat 312, responsive to the sensors 304 determining a change. For example, the actuator 306 may cause the polymer disposed within one or more portions 125 to change a configuration of the cleat 312 from a first profile to a second profile upon the sensors determining a value corresponding to a configuration condition for the second profile. The cleat 312 may be part of a plurality of cleats. The plurality of cleats may vary in size and configuration. The pattern of the plurality of cleats may vary responsive to the determined attributes of the surfaces. The cleats 312 may be controlled by the actuator 306 acting upon the sole 206.

In some embodiments, the transformable material or matter, such as the polymer or gel can be destabilized by applying a voltage to the material. In some embodiments, the electric voltage is applied by leads positioned within the third portion. For example, the actuator 306 can apply an electrical stimulation by leads positioned within the third portion to destabilize the polymer of the one or more portions 125. The applied voltage can be tuned based on the properties of the material. These properties can include rigidity, density, or hardness as measured by a durometer. The loss in some of these properties can be determined by a durometer or other type of sensor embedded in the shoe. In some embodiments, the durometer can determine a change in hardness responsive to determining a change in the coefficient of friction.

In some embodiments, the treads can be preprogrammed to switch between modes. In some cases, the modes can be like or refer to the different profiles 145 of FIG. 1. Upon determination of a value corresponding satisfying the configuration condition, the preprogrammed treads can change to their determined or programmed configuration based on the configuration condition. In some embodiments, the treads can include leads that are in contact with the transformable material, for instance a polymer or gel, and application of a voltage or other signal can cause the material to change states from fluid to solid based on the configuration of the tread. The material can change responsive to a change in the magnitude of the signal, frequency, phase shift, or other such characteristic depicted in a signal.

In some embodiments, the electronic circuit can contain a microchip to control different areas or regions of the tread to selective alter the state of the material in certain regions of the tread. In this way, the microchip can be programmed to form different tread patterns based on application of a voltage or other signal. The microchip can, in some embodiments, store data. The microchip could, for example, contain a variety of information about the shoe, including storing tread configurations responsive to the coefficient of friction, or the current state of the plurality of treads. The microchip can store information about whether the treads have deployed. The microchip could also communicate wirelessly. The chip could be programmed to enable a wireless interface override option. This interface may communicate with the computer chip using a plurality of mediums, including signals such as Bluetooth, WiFi, or another embodiment of communication protocol. This override interface can be used to manually input characteristics of the treads such as individual tread deployment, profile shape, tread pattern, or other such characteristics.

Figure 3G:
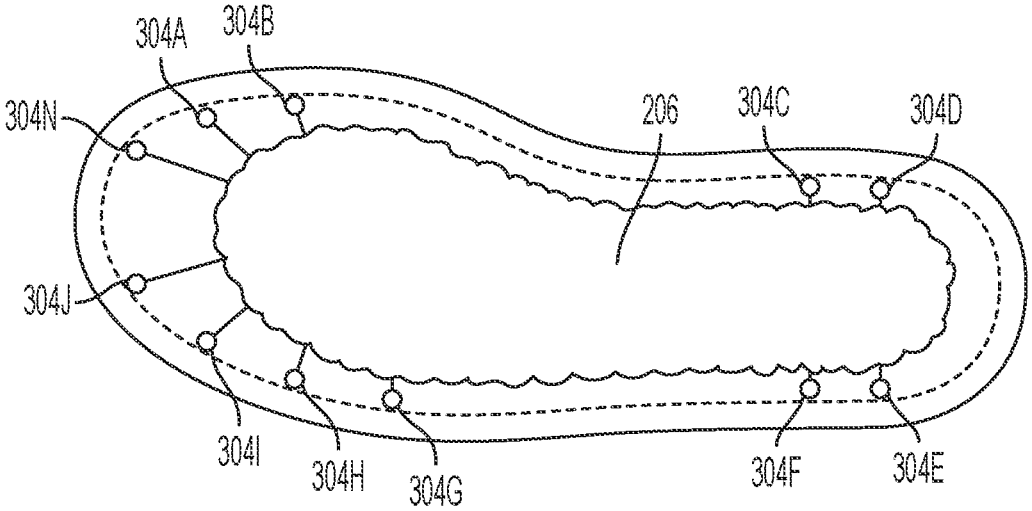
FIG. 3G illustrates a bottom view of an example configuration of sensors around the sole.

FIG. 3G illustrates a bottom view of an example configuration of sensors around the sole. The sensors 304 can be arranged in a plurality of patterns, and can comprise a plurality of sensor types. The sensors 304 can be like or include the sensors 130 as described herein. The sensors 304 can be affixed to the sole 206 in a plurality of methods. In one embodiment, the sensors 304 may be stitched into the sole. In another embodiment, the sensors may be embedded into the material of the sole. In yet another embodiment, the sensors are secured with glue or adhesive. The sensors 304 may be of a grade to withstand the forces implicit in being within the sole 206, for example human body weight, jumping forces, or lateral forces. The sensors 304 may be water resistant. The sensors 304 may extend throughout the sole 206.

Data from the sensors may be transmitted to other components in the shoe in a plurality of means, detailed herein. Some embodiments may use memory (for example onboard memory associated with a control unit) to store sensed data over time. In some embodiments, this data can be stored in association with the user record 140. For example, the user record 140 can include information related to sensor measurements, times of sensed measurements, times of a change to the configuration of the profile of the footwear, among others. This data may be stored for later upload and analysis, or this data may be continually transferred or transferred according to a schedule to the server 120, the client device 115, or the database 110. The data may be continuously uploaded to a subscription cloud server. Data can be used to indicate an athlete's performance on a particular field or field conditions or data that can be used to improve running.

For example, one embodiment of an article of footwear may sense and store friction information over time that can be later evaluated to look at trends in transformation. In some embodiments, the data from the sensors 304 can be transmitted to the server to enable a mapping. For example, the data transmitted from the sensors can include measurements regarding a location of the footwear, a distance traveled of the footwear, attributes of the surface in relation to the distance traveled of the footwear, among other. In this manner, a mapping of one or more surfaces can be created based on the determined sensor measurements. Based on the mapping, the actuator 135 may determine to change the configuration of the footwear from a first profile to a second profile in anticipation of the attributes on the surface as the wearer travels across the surface.

Figure 3H:
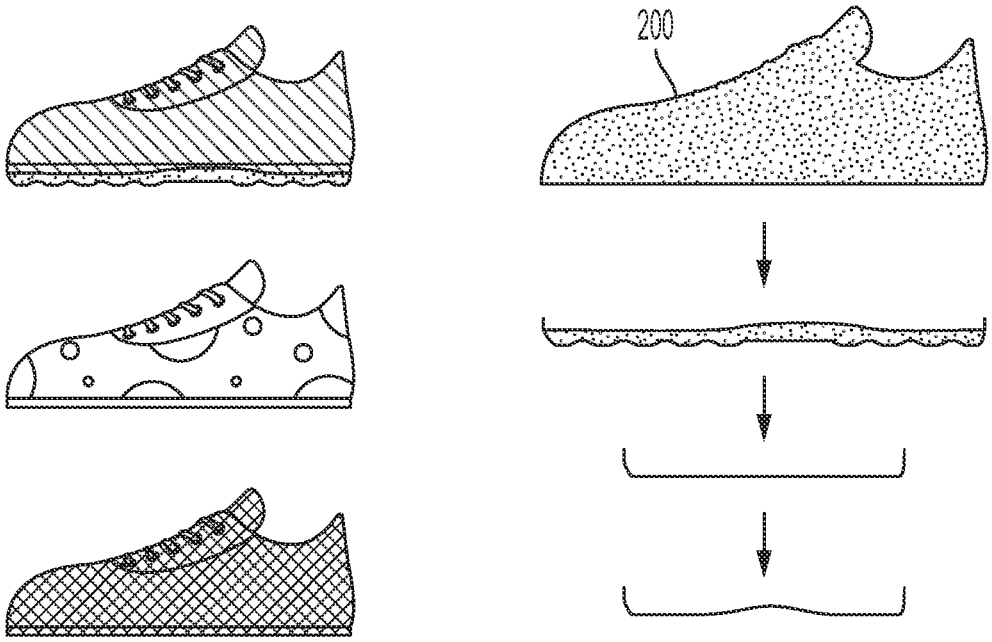
FIG. 3H illustrates an example model of the transformable shoe changing from various configurations.

FIG. 3H illustrates an example model of the transformable shoe changing between various configurations. Footwear 200 is shown undergoing an example transformation where the shoe transforms from a walking shoe, to a cleated shoe, to a treaded shoe, to a flat shoe.

Figure 4:
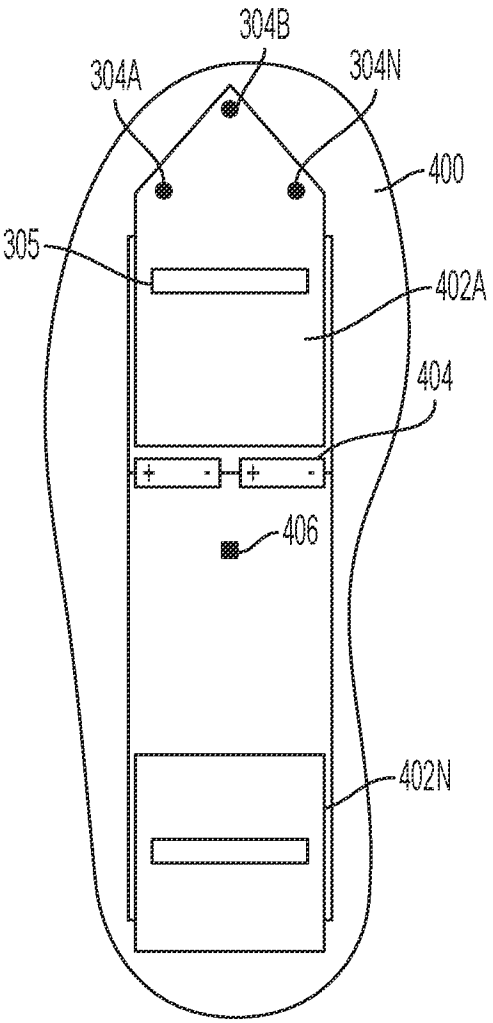
FIG. 4 illustrates a model of an electrical transformation method, according to an embodiment.

FIG. 4 illustrates a model of an electrical transformation method, according to an embodiment. This electrical transformation sole 400 may include a plurality of flexible circuit boards 402 connected to a first plurality of sensors 304, a second plurality of sensors 406, an electrical actuator 405, and a power source 404. These components may be connected in a plurality of ways, including via electrical wires, electrical bus bars, or any other means of connection. These components may communicate with each other using a plurality of mediums, including signals such as Bluetooth, WiFi, or another embodiment of communication protocol, or via hardwired connections, or another communication medium.

The electrical transformation sole 400 may be comprised of a plurality of materials. These materials may include, as an example, foam, rubber, metal, or polymers. The polymers may be configured to be transformed by the electrical actuator 405. The electrical actuator 405 may be like or include the actuator 135 and may be one of a plurality of actuators. The electrical actuator 405 transforms the sole 400 responsive to a change in stimulus determined by the first plurality of sensors 204.

The first plurality of sensors 204, as described above, can be comprised of a variety of sensors to determine values corresponding to the surface the shoe is interacting with. This variety can include, for example, friction sensors, light sensors, pressure sensors, or accelerometers. The first plurality of sensors 204 can be like or include at least some of the sensors 130. The second plurality of sensors 406 can be used to determine attributes of the shoe itself. These attributes can include, for example, temperature of the shoe, hardness of shoe portions, or moisture content in the shoe. The second plurality of sensors 406 can be like or include at least some of the sensors 130.

The flexible circuit board 402 can be configured to control various components of the shoe. The flexible circuit board 402 can include one or more flexible circuits boards, such as flexible circuit board 402A or flexible circuit board 402N. The flexible circuit board 402 can be configured to provide signals and instructions to the actuator, such as the actuator 405 or 135. The flexible circuit board 402 can be configured to accept power from the power source 404. The flexible circuit board can be configured to take inputs from the first plurality of sensors 204 and the second plurality of sensors 406. In some embodiments, the flexible circuit board can be configured to contain a power management system. The flexible circuit board may contain logic devices. The flexible circuit board 402 may contain additional capabilities not detailed herein.

The flexible circuit board 402 may be comprised of a variety of materials. These materials may include, for example, silicon, copper, carbon, carbon fiber, Constantan, cupro-nickel, Polyimide, screen printed dielectric, among others. The flexible circuit board is to be flexible enough to allow ordinary usage of the footwear, such as running, jumping, or pivoting. The flexible circuit board 402 may comprise one or more layers. The flexible circuit board 402 may be connected to an electrical actuator 405. The flexible circuit board 402 may send instructions to the actuator 405 denoting where and when to actuate. For example, the flexible circuit board may be coupled with or include the actuator 405. The flexible circuit board 402 may transmit signals or instructions to cause the at least one portion of the one or more portions 125 to change from a first profile 145A to a second profile 145B. For example, the flexible circuit board 402 may cause one or more protrusions of the sole to change from a first length to a second length. The flexible circuit board may pass an electric current to the actuator in order to enable functionality. The electrical actuator may output a mechanical force, an electrical force, or another type of force.

The electrical actuator 405 may transform the sole 400 of the shoe via a plurality of forces. In one embodiment, the electrical actuator 405 may impart a varying electric current onto the polymer sole 400. In this embodiment, the current can cause a change in the profile of the sole, responsive to the polymer transforming. In this embodiment, the polymer can be an electroactive polymer. Examples of electroactive polymers include those produced by Piezotech or Parker Hannifin. For example, different applied currents can cause a chemical reaction in the polymer, forcing it into the shape of a cleat. In some embodiments, the use of shape memory alloys or other deformable materials that can maintain or remember a shape when actuated can be used. In another embodiment, application of an electric force can cause a change in shape of the material, such as in the electroactive polymers detailed above. Upon release of this current, the polymer can return back to its original shape.

In some embodiments, the actuators can be MEMS based actuators that convert electrical signals into mechanical motion. Since MEMS based actuators are extremely small, they require very small amounts of energy to operate. A MEMS based actuator can be used to control one or more valves to control the flow of fluid materials, actuate a circuit or mechanical switch, which in turn can adjust the properties of the polymer to be transformed.

The current described above can, in one example, come directly from the power source 404. The current can also come by ways of the flexible circuit board 402, or the actuator 405, or any other component of the footwear. The power source 404 can be a rechargeable power source. In some embodiments, the power source can be recharged via a power cord, such as from a wall outlet to a micro USB or other such connector. In other embodiments, the power source can be recharged cordlessly, for example via induction. In still other embodiments, the power source may include one or more batteries. The power source can comprise a plurality of means by which to charge. In some embodiments, a charging port can be included in the footwear. In some embodiments, the batteries could be rechargeable and could be recharged in place or removed from an article for recharging.

Additional provisions could be incorporated to maximize battery power and/or otherwise improve use. For example, it is also contemplated that batteries could be used in combination with super caps to handle peak current requirements. In other embodiments, energy harvesting techniques could be incorporated which utilize the weight of the runner and each step to generate power for charging a battery. In other embodiments, the battery could be recharged via renewable energy, such as photovoltaics.

Figure 5B:
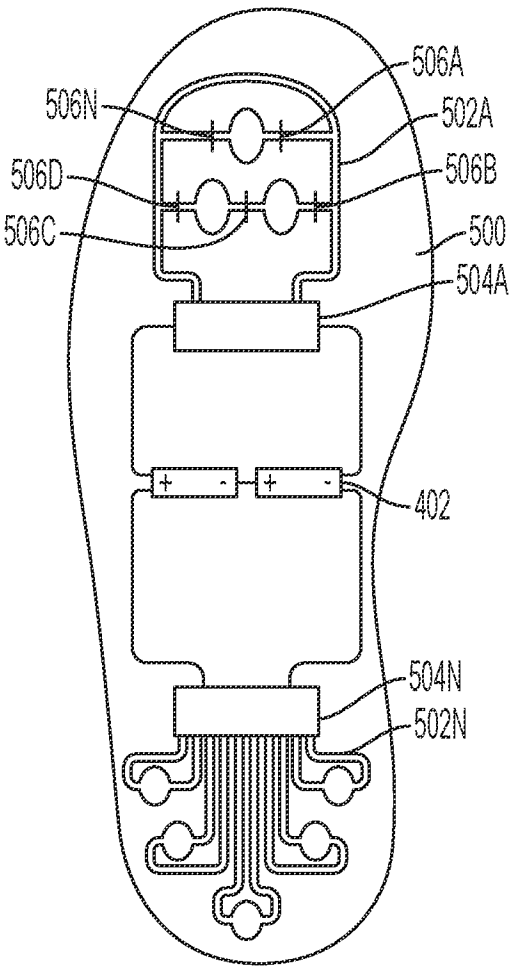
FIG. 5B illustrates a model of individually selectable transformation method, according to an embodiment.
Figure 5A:
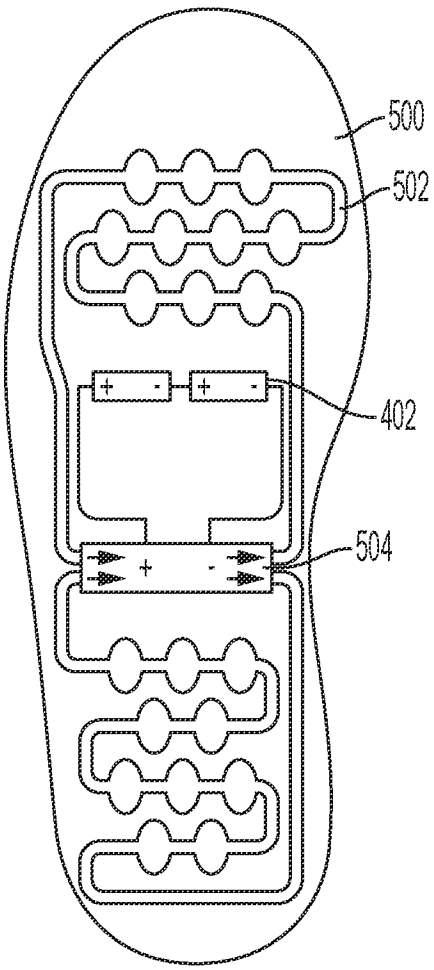
FIG. 5A illustrates a model of a single pneumatic transformation method, according to an embodiment.

FIG. 5A illustrates a model of a pneumatic transformation method, according to an embodiment. In this embodiment, the pneumatic transformation occurs when pneumatic protrusions 502 contained within a pneumatic sole 500 are deployed by a pneumatic actuator 504. In this example, all pneumatic protrusions 502 will deploy at the same time, however it should be understood that different profiles 145 may correspond to different deployments, patterns, or lengths of the pneumatic protrusions 502. The pneumatic protrusions 502 may be a plurality of cleats or treads. The pneumatic protrusions 502 are not to be limited in size or shape.

The pneumatic actuator 504 is powered by a power source 404 as described above. The pneumatic actuator 504 may be a plurality of actuators. The pneumatic actuator 504 can, in an embodiment, force a fluid towards the pneumatic protrusions 502. This fluid can be water, air, mineral oil, or any other of a variety of fluids known to be used in pneumatic systems. The pneumatic protrusions can be comprised of a system of tubing and moldable materials. These materials can include rubber, silicone, polymers, or other materials that can react to pressure in order to change shape.

In an embodiment, the pneumatic system can contain some or all of the features taught in FIG. 4. This system can, for example, sense an input as described above and cause the pneumatic actuator 504 to function. The pneumatic actuator 504 can, in this example, force a fluid contained within the sole of the pneumatic protrusions to become pressurized. This pressurization can act upon a polymer or other material susceptible to pressure contained within the sole 500 and force the profile of the sole to change shape, according to an embodiment. Responsive to sensing a second change in surface, the actuator 504 can alleviate the pressure induced to allow the pneumatic protrusions 502 to rescind.

FIG. 5B illustrates an alternative model of a pneumatic transformation method, according to an embodiment. In this embodiment, the pneumatic transformation can allow one or more cleats to deploy in different configurations. The pneumatic transformation occurs when the pneumatic protrusions 502 as described above are pressurized by the pneumatic actuator 504.

In this embodiment, each protrusion can be individually controlled. This individual control can come from the actuator 504, or from a series of valves 506, or from another method of pneumatic control. The valves can be a plurality of valves configured to control the pressure allowed to each individual protrusions. The valves can be of a variety of ports and directions, as known to those skilled in the art. The valves can be automatically controlled, as by a flexible circuit board as described above or through any other medium for controlling valves. The configuration of deployment can be user controlled.

Figure 6B:
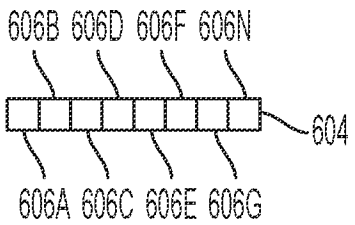
FIG. 6B illustrates an example pixel array, according to an embodiment.
Figure 6A:
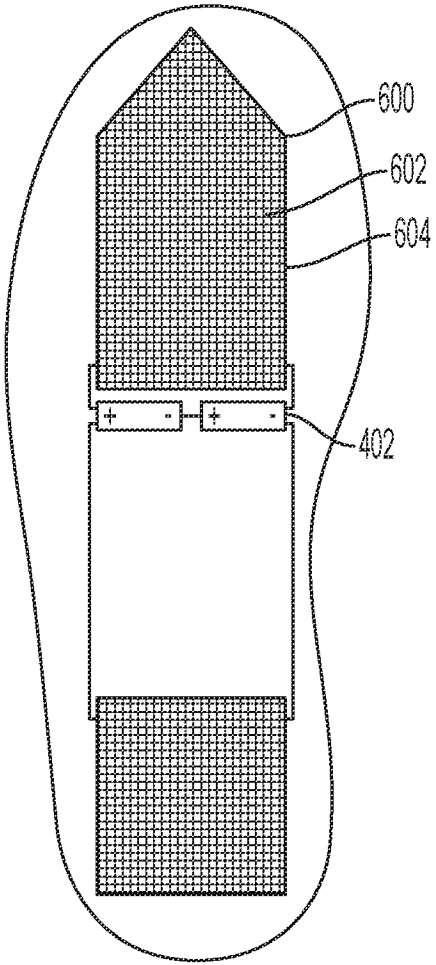
FIG. 6A illustrates a model of a thermal printer transformation method, including a pixelated array, according to an embodiment.

FIG. 6A illustrates a model of a thermal printer transformation method, including a pixelated array, according to an embodiment. This method can include a thermal sole 600, configured to react to a thermal actuation from a thermal printer 602. This thermal printer 602 can include a pixelated thermal array 604, described in more detail below in FIG. 6B.

The thermal printer can include a flexible circuit board as described above, according to an embodiment. The printer can, in an example, apply heat to portions of the sole 600 in a pinpointed manner as to cause portions of the sole to change in profile. The sole 600 can be made of a variety of materials, including rubber, metal, leather, or polymers. In an example, a polymer can be made to change shape into a configuration of cleats responsive to a heat being applied. The application of the heat from the thermal printer 602 can be responsive to changes in the surface sensed by the footwear. Upon a second change in the determined surface, the printer 602 can change temperature to the applied to heat in order to change the configuration of cleats again, or to revert back to their original shape, in an embodiment.

FIG. 6B illustrates an example pixel array, exploded from the FIG. 6A view. The array 604 comprises a plurality of thermal pixels 606. Each pixel is individually controllable to allow for customization of the profile of the sole. In an embodiment, the pixels 606 can be controlled to a plurality of temperatures and shapes. This variance enables a customizable transformable sole pattern.

FIGS. 6A-C exhibits example tread patterns. These tread patterns are examples of the plurality of customizable tread patterns possible, such as contained within the profiles 145.

Figure 7C:
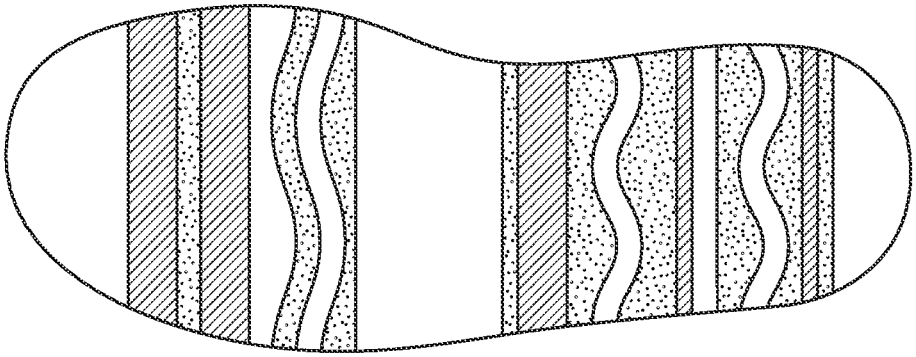
FIGS. 7A-7C illustrate example tread patterns, according to an embodiment.
Figure 7B:
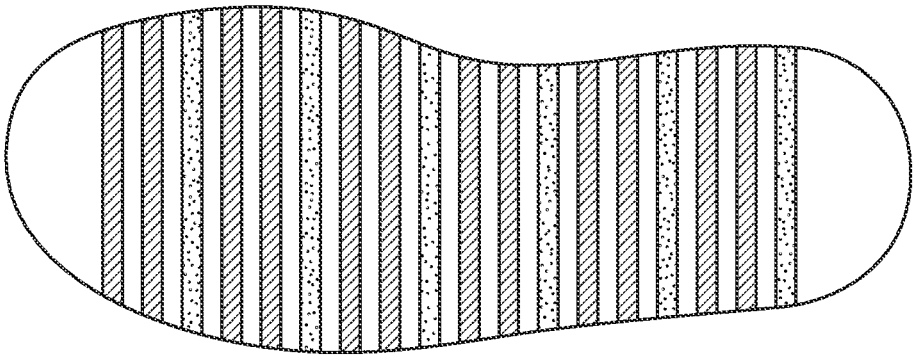
Figure 7A:
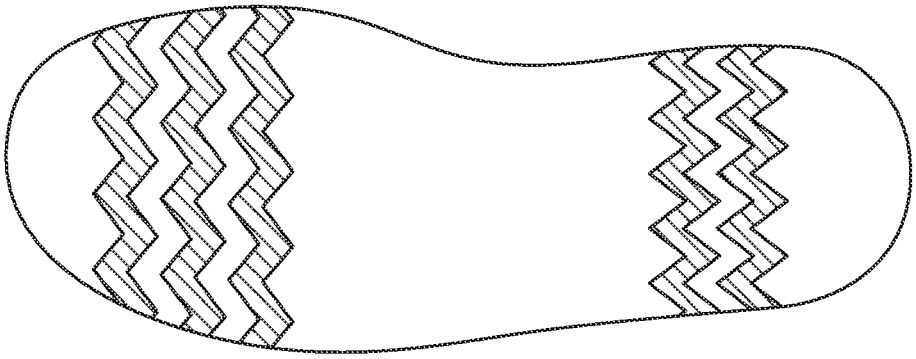
Figure 8C:
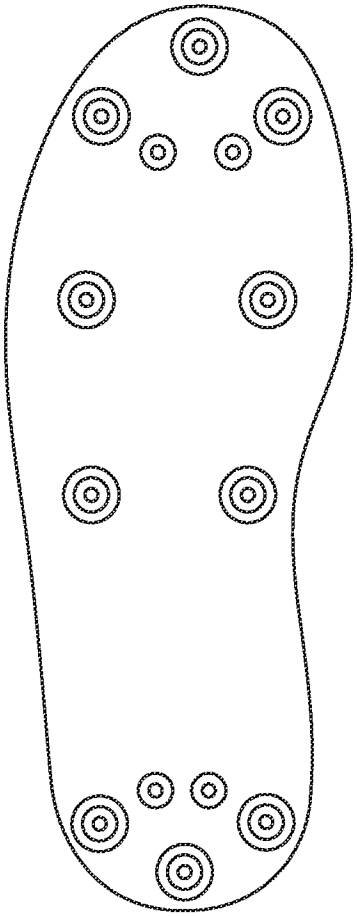
FIGS. 8A-8C illustrate example cleat patterns, according to an embodiment.
Figure 8B:
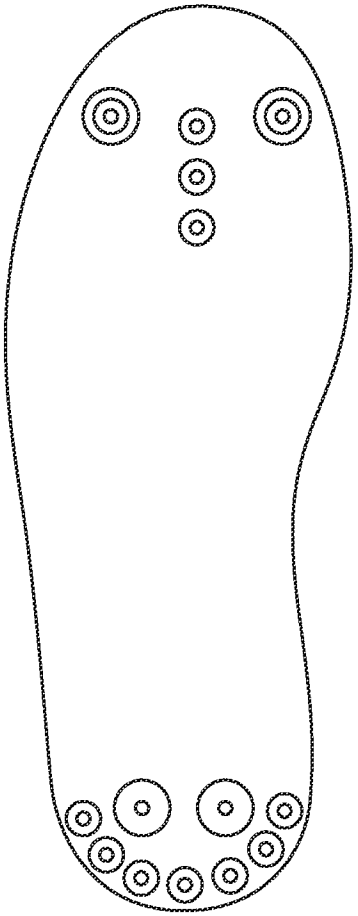
Figure 8A:
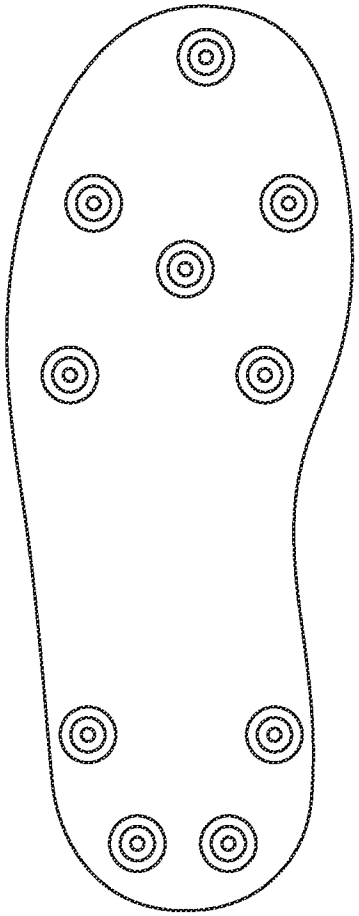

FIGS. 7A-C exhibits example cleat patterns. These cleat patterns are examples of the plurality of customizable cleat patterns possible, such as contained within the profiles 145. These cleat patterns can, in an embodiment, be combined with a plurality of tread patterns to create a plurality of cleat and tread patterns.

As used herein, the singular terms "a," "an," and "the" may include plural referents unless the context clearly dictates otherwise. Spatial descriptions, such as "above," "below," "up," "left," "right," "down," "top," "bottom," "vertical," "horizontal," "side," "higher," "lower," "upper," "over," "under," and so forth, are indicated with respect to the orientation shown in the figures unless otherwise specified. It should be understood that the spatial descriptions used herein are for purposes of illustration only, and that practical implementations of the structures described herein can be spatially arranged in any orientation or manner, provided that the merits of embodiments of this disclosure are not deviated by such arrangement.

Any references to implementations or elements or acts of the systems and methods herein referred to in the singular can include implementations including a plurality of these elements, and any references in plural to any implementation or element or act herein can include implementations including only a single element. References in the singular or plural form are not intended to limit the presently disclosed systems or methods, their components, acts, or elements to single or plural configurations. References to any act or element being based on any information, act or element may include implementations where the act or element is based at least in part on any information, act, or element.

Any implementation disclosed herein may be combined with any other implementation, and references to "an implementation," "some implementations," "an alternate implementation," "various implementations," "one implementation" or the like are not necessarily mutually exclusive and are intended to indicate that a particular feature, structure, or characteristic described in connection with the implementation may be included in at least one implementation. Such terms as used herein are not necessarily all referring to the same implementation. Any implementation may be combined with any other implementation, inclusively or exclusively, in any manner consistent with the aspects and implementations disclosed herein.

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of 'A' and 'B'" can include only 'A', only 'B', as well as both 'A' and 'B'. Elements other than 'A' and 'B' can also be included.

The systems and methods described herein may be embodied in other specific forms without departing from the characteristics thereof. The foregoing implementations are illustrative rather than limiting of the described systems and methods.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements.

The systems and methods described herein may be embodied in other specific forms without departing from the characteristics thereof. The foregoing implementations are illustrative rather than limiting of the described systems and methods. Scope of the systems and methods described herein is thus indicated by the appended claims, rather than the foregoing description, and changes that come within the meaning and range of equivalency of the claims are embraced therein.

While the present disclosure has been described and illustrated with reference to specific embodiments thereof, these descriptions and illustrations do not limit the present disclosure. It should be understood by those skilled in the art that various changes may be made and equivalents may be substituted without departing from the true spirit and scope of the present disclosure as defined by the appended claims. The illustrations may not be necessarily drawn to scale. There may be distinctions between the artistic renditions in the present disclosure and the actual apparatus due to manufacturing processes and tolerances. There may be other embodiments of the present disclosure which are not specifically illustrated. The specification and drawings are to be regarded as illustrative rather than restrictive. Modifications may be made to adapt a particular situation, material, composition of matter, method, or process to the objective, spirit and scope of the present disclosure. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the present disclosure. Accordingly, unless specifically indicated herein, the order and grouping of the operations are not limitations of the present disclosure.

What is claimed is:

1. A footwear system comprising:

one or more portions including an outsole configured in a first profile, the one or more portions comprising an electroactive polymer;

one or more sensors coupled to the outsole and configured to generate a value based on a surface of a ground with which the outsole comes into contact; and an electrical actuator configured to apply, responsive to determining that the value satisfies a profile configuration condition, a varying electrical current directly to the electroactive polymer of the one or more portions to transform the electroactive polymer to change a configuration of the one or more portions from the first profile to a second profile in accordance with the surface of the ground, wherein the one or more portions configured in the first profile includes one or more protrusions extending from the outsole at a first length, and wherein the one or more portions configured in the second profile includes the one or more protrusions extending from the outsole at a second length.

2. The footwear system of claim 1, wherein the surface is a first surface, wherein the value is a first value, wherein the profile configuration condition is a first profile configuration condition, and wherein the electrical actuator is configured to change, responsive to determining that a second value based on a second surface in contact with the at least one of the one or more portions satisfies a second profile configuration condition, the configuration of the one or more portions from the second profile to a third profile in accordance with the second surface.

3. The footwear system of claim 1, wherein the electrical actuator is coupled with a memory and configured to identify, responsive to determining that the value satisfies the profile configuration condition, the second profile from a plurality of profiles stored in the memory based on the value.

4. The footwear system of claim 1, wherein the electrical actuator is configured to expand at least one portion of the one or more portions in at least one of a longitudinal or lateral direction to change the configuration of the one or more portions from the first profile to the second profile.

5. The footwear system of claim 1, wherein to change the configuration of the one or more portions from the first profile to the second profile in accordance with the surface, the electrical actuator is configured to apply the varying electrical current to alter a state of the electroactive polymer of the one or more portions to cause the first profile to change to the second profile.

6. The footwear system of claim 1, wherein the one or more portions configured in the first profile includes a sole configured in a first sole pattern and wherein the one or more portions configured in the second profile includes the sole configured in a second sole pattern.

7. The footwear system of claim 6, wherein the first sole pattern comprises one of a first number of protrusions, first shape of protrusions, first dimension of protrusions, first rigidity of protrusions, and a first set of locations of protrusions and wherein the second sole pattern comprises one of a second number of protrusions, second shape of protrusions, second dimension of protrusions, second rigidity of protrusions, and a second set of locations of protrusions.

8. The footwear system of claim 1, comprising a user record configured to store information related to the surface and the one or more protrusions in accordance with a schedule.

9. The footwear system of claim 1, wherein the value is a first value, wherein the one or more sensors are configured to generate a second value based on a movement of the one or more portions, and wherein the electrical actuator is configured to change the configuration of the one or more portions from the first profile to the second profile based on the second value.

* * * * *